US012774553B2

(12) United States Patent
Park et al.

(10) Patent No.: US 12,774,553 B2
(45) Date of Patent: Oct. 27, 2026

(54) LAUNDRY TREATING APPARATUS AND METHOD FOR CONTROLLING THE LAUNDRY TREATING APPARATUS

(71) Applicant: LG Electronics Inc., Seoul (KR)

(72) Inventors: Bio Park, Seoul (KR); Byeongjo Ryoo, Seoul (KR); Haewoong Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 1128 days.

(21) Appl. No.: 17/776,095

(22) PCT Filed: Dec. 16, 2020

(86) PCT No.: PCT/KR2020/018405
§ 371 (c)(1),
(2) Date: May 11, 2022

(87) PCT Pub. No.: WO2021/125771
PCT Pub. Date: Jun. 24, 2021

(65) Prior Publication Data

US 2022/0389646 A1 Dec. 8, 2022

(30) Foreign Application Priority Data

Dec. 17, 2019 (KR) ..... 10-2019-0169254

(51) Int. Cl.
*D06F 58/45* (2020.01)
*D06F 58/20* (2006.01)
(Continued)

(52) U.S. Cl.
CPC ..... *D06F 58/45* (2020.02); *D06F 58/206* (2013.01); *D06F 58/22* (2013.01); *D06F 58/24* (2013.01);
(Continued)

(58) Field of Classification Search
CPC ..... D06F 58/45; D06F 58/206; D06F 58/22; D06F 58/24; D06F 2103/08;
(Continued)

(56) References Cited

U.S. PATENT DOCUMENTS

2010/0146809 A1* 6/2010 Grunert ..... D06F 58/45 34/88
2018/0171537 A1* 6/2018 Lee ..... B08B 3/14

FOREIGN PATENT DOCUMENTS

CN 103547728 1/2014
CN 104911882 9/2015
(Continued)

OTHER PUBLICATIONS

International Search Report and Written Opinion in International Appln. No. PCT/KR2020/018405, dated Apr. 12, 2021, 10 pages.
(Continued)

*Primary Examiner* — Jessica Yuen
(74) *Attorney, Agent, or Firm* — Fish & Richardson P.C.

(57) ABSTRACT

Disclosed is a laundry treating apparatus including: a water discharger supply pipe for supplying water stored in a water collector to a water discharger; a water supply pipe constructed to connect the water discharger and the water collector to each other; and a water collector water-level sensor for measuring a water-level inside the water collector, and a controller configured to control the laundry treating apparatus comprising: a water-level sensing operation in which the water collector water-level sensor measures the water-level of the water collector during a drying operation; and a cleaning water supply operation in which when the water-level of the water collector is lower than a predefined cleaning-related reference water-level, a water supply valve is controlled to supply water stored in the water discharger to the water collector.

18 Claims, 8 Drawing Sheets

(51) Int. Cl.

| | |
|---|---|
| ***D06F 58/22*** | (2006.01) |
| ***D06F 58/24*** | (2006.01) |
| ***D06F 103/08*** | (2020.01) |
| ***D06F 103/58*** | (2020.01) |
| ***D06F 105/02*** | (2020.01) |
| ***D06F 105/44*** | (2020.01) |
| ***D06F 105/58*** | (2020.01) |

(52) U.S. Cl.
CPC ..... *D06F 2103/08* (2020.02); *D06F 2103/58* (2020.02); *D06F 2105/02* (2020.02); *D06F 2105/44* (2020.02); *D06F 2105/58* (2020.02)

(58) Field of Classification Search
CPC ..... D06F 2103/58; D06F 2105/02; D06F 2105/44; D06F 2105/58; D06F 25/00; D06F 2105/34
See application file for complete search history.

(56) References Cited

FOREIGN PATENT DOCUMENTS

| | | | | |
|---|---|---|---|---|
| CN | 105506939 | | 4/2016 | |
| CN | 107109768 | | 8/2017 | |
| CN | 108291357 | | 7/2018 | |
| DE | 102014204299 | | 9/2015 | |
| EP | 0789105 | | 8/1997 | |
| EP | 2334864 | | 6/2011 | |
| EP | 3023534 | | 5/2016 | |
| EP | 3024969 | | 6/2016 | |
| EP | 2691567 | B1 * | 11/2016 | ..... D06F 58/22 |
| EP | 3366829 | | 8/2018 | |
| KR | 100762332 | | 10/2007 | |
| KR | 10-2011-0123360 | A | 11/2011 | |
| KR | 10-2011-0125570 | | 11/2011 | |
| KR | 20160049733 | | 5/2016 | |
| KR | 20180027046 | | 3/2018 | |
| KR | 20190128484 | | 11/2019 | |
| RU | 2628930 | | 8/2017 | |
| WO | WO 2010/028992 | | 3/2010 | |
| WO | WO 2015/082018 | | 6/2015 | |
| WO | WO 2016/045173 | | 3/2016 | |

OTHER PUBLICATIONS

Notice of Allowance in Russian Appln. No. 2022112519, mailed on Dec. 15, 2022, 29 pages (with English translation).
Office Action in Chinese Appln. No. 202080088324.9, mailed on Apr. 22, 2023, 23 pages (with English translation).
Extended European Search Report in European Appln. No. 20901642.7, mailed on Oct. 18, 2023, 6 pages.
Office Action in Chinese Appln. No. 202080088324.9, mailed on Oct. 18, 2023, 24 pages (with English translation).

* cited by examiner

LAUNDRY TREATING APPARATUS AND METHOD FOR CONTROLLING THE LAUNDRY TREATING APPARATUS

CROSS-REFERENCE TO RELATED APPLICATIONS

This application is a National Stage application under 35 U.S.C. § 371 of International Application No. PCT/KR2020/018405, filed on Dec. 16, 2020, which claims the benefit of Korean Application No. 10-2019-0169254, filed on Dec. 17, 2019. The disclosures of the prior applications are incorporated by reference in their entirety.

TECHNICAL FIELD

The present disclosure relates to a laundry treating apparatus and a method for controlling the laundry treating apparatus.

BACKGROUND ART

A laundry treating apparatus refers to a generic term of an apparatus for washing laundry, an apparatus for drying laundry, and an apparatus capable of washing and drying laundry.

A conventional laundry treating apparatuses capable of drying laundry may include a drum that provides a space for storing laundry, a duct that defines a channel that re-supplies air discharged from the drum to the drum, a first heat exchanger that cools air introduced into the duct from the drum to remove moisture included in the air, a second heat exchanger that heats air that has passed through the first heat exchanger, and a fan that moves air passing through the second heat exchanger to the drum.

In the conventional laundry treating apparatus having the above structure, the air discharged from the drum is dehumidified and heated while passing through the heat exchangers, and then is resupplied to the drum. Thus, contaminants such as lint remain in the heat exchangers. To solve such a problem, each of some conventional laundry treating apparatuses is configured to include a filter for filtering air supplied to the first heat exchanger or a nozzle for ejecting water to the filter or the heat exchanger (EP2691567B 1).

A conventional laundry treating apparatus that ejects water to remove contaminants from the filter or the heat exchanger generally uses water (condensate water) discharged from air passing through the first heat exchanger during drying of the laundry. An approach of supplying the condensate water generated during drying of the laundry to the filter is largely divided into a scheme using potential energy and a scheme using pump.

The approach using the potential energy (KR101410595) includes moving the condensate water generated during drying to a water discharge tank located at a top of the drum and then draining the water from the water discharge tank toward the filter or the heat exchanger at a timing when the filter requires cleaning thereof. The approach using the pump (EP2691567B1) includes supplying the condensate water generated during drying to the filter or the heat exchanger using the pump.

The two approaches as described above have a problem in that whether the filter or the heat exchanger is able to be cleaned and an amount of cleaning thereof are determined based on an amount of condensate water generated during the drying. That is, in both the approaches, the filter or the heat exchanger is cleaned with only the condensate water generated during drying, without a process of determining whether an amount (a cleaning-related reference water-level) of the condensate water as required for cleaning of the filter or the heat exchanger has been collected, and a process in which when less condensate water is collected than the amount required for cleaning, water is supplemented. Thus, in both the approaches, the conventional laundry treating apparatus has a problem in that the apparatus does not sufficiently clean the filter or the heat exchanger when the amount of the condensate water is small.

DISCLOSURE OF INVENTION

Technical Problem

A purpose of the present disclosure is to provide a laundry treating apparatus and a method for controlling the laundry treating apparatus, wherein when a water-level of a water collector where condensate water is stored is lower than a water-level required for cleaning of a filter assembly or a heat exchanger, the water collector is configured to receive water from a water supply source (a water discharger) located inside a cabinet or a water supply source located outside the cabinet.

Further, a purpose of the present disclosure is to provide a laundry treating apparatus and a method for controlling the laundry treating apparatus, wherein when an amount of water (condensate water) generated when air passes through the heat exchanger during drying is lower than an amount of cleaning water required for cleaning the filter assembly or the heat exchanger, the laundry treating apparatus is configured to guide a user to supply the cleaning water.

Further, a purpose of the present disclosure is to provide a laundry treating apparatus and a method for controlling the laundry treating apparatus, wherein when an amount of condensate water generated during drying is lower than an amount of cleaning water required for cleaning the filter assembly or the heat exchanger, the laundry treating apparatus is configured to forcibly prevent a user from discarding condensate water generated during drying so that the filter assembly or the heat exchanger must be cleaned during subsequent drying.

Further, a purpose of the present disclosure is to provide a laundry treating apparatus and a method for controlling the laundry treating apparatus, wherein the laundry treating apparatus is configured to predict an amount of condensate water that may be generated during a drying operation before initiation of the drying operation, and when the predicted amount of the condensate water is lower than an amount of cleaning water required for cleaning the filter assembly or the heat exchanger, the apparatus is configured to guide the user to supply the cleaning water.

Solution to Problem

The present disclosure provides a method for controlling a laundry treating apparatus, the method including: a drying operation of sequentially dehumidifying and heating air discharged from a drum to supply low-humidity heated air to the drum; a water-level sensing operation in which a water collector water-level sensor measures a water-level of a water collector in which water generated in the dehumidification process is stored during the drying operation; a water discharge operation in which when a dryness of laundry is lower than a predefined reference dryness and the water-level of the water collector is greater than or equal to a predefined cleaning-related reference water-level, water from the water collector flows to a water discharger having a space defined therein for storing water therein; a cleaning operation in which when the dryness of laundry is higher than or equal to the predefined reference dryness and the water-level of the water collector is greater than or equal to the cleaning-related reference water-level, water from the water collector is supplied to a water ejector to clean a filter assembly that filters air moving to the heat exchanger; and a cleaning water supply operation in which when the dryness of laundry is higher than or equal to the predefined reference dryness and the water-level of the water collector is lower than the cleaning-related reference water-level, water from the water discharger is supplied to the water collector.

When the dryness of the laundry reaches a target dryness set to a dryness higher than the reference dryness, the control method may terminate the drying operation; and may perform a last water discharge operation of transferring water stored in the water collector to the water discharger through a water discharger supply pipe after termination of the drying operation. The reference dryness may be set to a value of 40% to 50% or greater of the target dryness.

One aspect of the present disclosure provides a method for controlling a laundry treating apparatus, wherein the laundry treating apparatus includes: a drum having a laundry storage space defined therein; a duct defining a channel for supplying air discharged from the drum back to the drum; a fan to move air along the duct; a heat-absorber for removing moisture from air introduced into the duct; a heat-emitter disposed inside the duct to heat air passing through the heat-absorber; a water collector for storing therein water discharged from air passing through the heat-absorber; a filter assembly disposed in the duct to filter air moving to the heat-absorber; a water discharger having a water storage space defined therein; a water discharger supply pipe for supplying water stored in the water collector to the water discharger; a water ejector for ejecting water into the filter assembly; a water ejector supply pipe for supplying water stored in the water collector to the water ejector; a water supply pipe constructed to connect the water discharger and the water collector to each other; a water supply valve for controlling opening and closing of the water supply pipe; and a water collector water-level sensor for measuring a water-level inside the water collector, wherein the method includes: a drying operation in which the fan, the heat-absorber, and the heat-emitter work to perform heat exchange between air and laundry in the drum; a water-level sensing operation in which the water collector water-level sensor measures the water-level of the water collector during the drying operation; a cleaning water supply operation in which when the water-level of the water collector is lower than a predefined cleaning-related reference water-level, the water supply valve is controlled to supply water stored in the water discharger to the water collector; and a cleaning operation in which after completion of the cleaning water supply operation, water is supplied from the water collector to the water ejector to clean the filter assembly.

In one implementation of the method, each of the cleaning water supply operation and the cleaning operation is initiated when a dryness of laundry measured using at least one of an electrode sensor or a humidity sensor is equal to or greater than a predefined reference dryness, wherein the humidity sensor measures a humidity of air flowing from the drum to the duct, wherein the electrode sensor is configured to contact the laundry and measure an amount of moisture contained in the laundry.

In one implementation of the method, the method further includes: a termination operation in which when the dryness of the laundry measured by at least one of the humidity sensor or the electrode sensor reaches a target dryness higher than the reference dryness, the drying operation is terminated; and a last water discharge operation in which after the termination of the drying operation, water stored in the water collector flows to the water discharger through the water discharger supply pipe.

In one implementation of the method, the reference dryness may be set to a value of 40% to 50% or greater of the target dryness.

In one implementation of the method, the method further includes a water discharge operation in which when the water-level of the water collector measured after completion of the cleaning operation is greater than or equal to a predefined discharge-related reference water-level, water stored in the water collector flows to the water discharger through the water discharger supply pipe.

In one implementation of the method, the method further includes a water discharge operation in which when a dryness of air flowing from the drum to the duct is lower than the reference dryness, and the water-level of the water collector is greater than or equal to a predefined discharge-related reference water-level, water stored in the water collector flows to the water discharger through the water discharger supply pipe.

In one implementation of the method, when the water-level of the water collector measured after completion of the cleaning water supply operation is greater than or equal to the cleaning-related reference water-level, the cleaning operation is initiated when the water-level of the water collector measured after completion of the cleaning water supply operation reaches the cleaning-related reference water-level, wherein when the water-level of the water collector measured after completion of the cleaning water supply operation is lower than the cleaning-related reference water-level, the cleaning operation is initiated when a predefined reference time duration has elapsed from a completion timing of the cleaning water supply operation.

In one implementation of the method, the method further includes at least one of: a notification operation in which when the water-level of the water collector measured after completion of the cleaning water supply operation is lower than the cleaning-related reference water-level, a message requesting a user not to empty water stored in the water discharger is outputted using at least one of a display panel or a speaker; or a locking operation in which when the water-level of the water collector measured after completion of the cleaning water supply operation is lower than the cleaning-related reference water-level, a lock is activated to lock the water discharger.

In one implementation of the method, the method further includes: a notification operation in which when the water-level of the water collector measured after completion of the cleaning water supply operation is lower than the cleaning-related reference water-level, a message requesting a user to supply water to the water discharger is outputted using at least one of a display panel or a speaker; and a connection operation in which during the notification operation or after completion of the notification operation, the water supply valve opens the water supply pipe to connect the water discharger and the water collector to each other, wherein when the water-level of the water collector measured after completion of the connection operation is greater than or equal to the cleaning-related reference water-level, the cleaning operation is initiated when the water-level of the water collector reaches the cleaning-related reference water-level, wherein when the water-level of the water collector measured after completion of the connection operation is lower than the cleaning-related reference water-level, the cleaning operation is initiated when a predefined reference time duration has elapsed after completion of the notification operation.

In one implementation of the method, the method further includes at least one of: a notification operation in which when the water-level of the water collector measured after completion of the connection operation is lower than the cleaning-related reference water-level, a message requesting a user not to empty water stored in the water discharger is outputted using at least one of a display panel or a speaker; or a locking operation in which when the water-level of the water collector measured after completion of the connection operation is lower than the cleaning-related reference water-level, a lock is activated to lock the water discharger.

In one implementation of the method, the method further includes: a prediction operation which occurs before initiation of the drying operation and in which an amount of water collectible in the water collector until the reference dryness is satisfied is predicted based on an amount of laundry measured using a laundry amount sensor; and a prediction result notification operation in which when a sum of a water-level measured by a water discharger water-level sensor detecting a water-level inside the water discharger and a water-level corresponding to the predicted amount measured in the prediction operation is lower than the cleaning-related reference water-level, a message requesting a user to supply water to the water discharger is outputted using at least one of a display panel or a speaker.

In one implementation of the method, the prediction result notification operation may be initiated when a sum of the water-level measured by the water discharger water-level sensor, the water-level measured by the water collector water-level sensor, and the water-level corresponding to the predicted amount measured in the prediction operation is lower than the cleaning-related reference water-level.

In one implementation of the method, the method further includes: a detergent input request operation in which when a request of cleaning using detergent is input to an input interface receiving a control command from a user after completion of the last water discharge operation, a message requesting detergent input to the water discharger is outputted using at least one of a display panel or a speaker; and a mixed liquid supply operation in which the water supply valve is controlled such that a mixed liquid of water and detergent stored in the water discharger is supplied to the water collector; a mixed liquid ejection operation in which the mixed liquid stored in the water collector is supplied to the water ejector to clean the filter assembly; and a mixed liquid discharge operation in which the mixed liquid inside the water collector flows to the water discharger after completion of the mixed liquid ejection operation.

In one implementation of the method, the method further includes a filter assembly drying operation in which after completion of the mixed liquid discharge operation, the fan is activated to dry the filter assembly.

Another aspect of the present disclosure provides a laundry treating apparatus comprising: a cabinet having a laundry inlet defined in a front face thereof; a drum rotatably disposed inside the cabinet and having a laundry storage space defined therein, and communicating with the laundry inlet; a duct defining a channel for supplying air discharged from the drum back to the drum; a fan to allow air inside the drum to circulate along the duct; a heat exchanger including a heat-absorber to remove moisture from air introduced into the duct and a heat-emitter disposed inside the duct to heat air passing through the heat-absorber; a water collector for storing therein water removed from air passing through the heat-absorber; a filter assembly disposed in the duct to filter air moving to the heat-absorber; a water discharger including a water storage body detachably disposed in the cabinet and having a water storage space defined therein, and an inlet constructed to pass through the water storage body; a water discharger supply pipe for guiding water stored in the water collector to the inlet; a water ejector configured to eject water into at least one of the filter assembly or the heat-absorber; a water ejector supply pipe for supplying water stored in the water collector to the water ejector; a water supplier including: a water discharge hole defined to pass through the water storage body to discharge water inside the water storage body therethrough; a water discharge valve to open and close the water discharge hole; a valve actuator to control the water discharge valve to open the water discharge hole when the water storage body is fixed to the cabinet; a water supply pipe for guiding water discharged from the water discharge hole to the water collector; and a water supply valve for controlling opening and closing of the water supply pipe; a water collector water-level sensor configured to detect a water-level inside the water collector; and a controller configured to control the water supply valve to move water from the water storage body to the water collector when the water-level measured using the water collector water-level sensor is lower than a predefined cleaning-related reference water-level.

In one implementation of the apparatus, the apparatus further includes: a communication hole defined to pass through a top face of the water storage body; a storage body water supply hole defined to pass through a top face of the cabinet and located above the communication hole; and a water supply hole door configured to open and close the water supply hole.

In one implementation of the apparatus, the storage body water supply hole may be defined in a front portion close to the laundry inlet among the front portion and a rear portion of a top face of the cabinet.

In one implementation of the apparatus, the apparatus further includes: a water discharger insertion hole defined to pass through one face of the cabinet, wherein the water storage body is drawn out of the cabinet or inserted into the cabinet through the water discharger insertion hole; a panel fixed to the water storage body and attachable or detachable to or from the water discharger insertion hole; a panel water supply hole defined to pass through the panel; a communication hole defined to pass through a top face of the water storage body; and a channel defining portion constructed to guide water flowing into the panel water supply hole to the communication hole.

In one implementation of the apparatus, the apparatus further includes: a water discharger insertion hole defined to pass through one face of the cabinet, wherein the water storage body is drawn out of the cabinet or inserted into the cabinet through the water discharger insertion hole; a panel fixed to the water storage body and attachable or detachable to or from the water discharger insertion hole; and a lock, wherein the lock includes a bar fastener disposed on at least one of the panel or the water storage body, and a bar disposed on the cabinet and detachably coupled to the bar fastener.

In one implementation of the apparatus, when a water-level of the water collector measured after water in the water storage body is supplied to the water collector through the water supplier is lower than the cleaning-related reference water-level, the controller is configured to control the lock so that the water storage body is fixed to the cabinet.

In one implementation of the apparatus, the apparatus further includes: a floater ascending or descending along a height direction of the water storage body according to a water-level inside the water storage body; a permanent magnet fixed to the floater; and a magnetic force sensor disposed in the cabinet for transmitting a magnitude of a magnetic force exerted from the permanent magnet to the controller

Advantageous Effects of Invention

The present disclosure may realize the laundry treating apparatus and the method for controlling the laundry treating apparatus, wherein when a water-level of the water collector where condensate water is stored is lower than a water-level required for cleaning of the filter assembly or the heat exchanger, the water collector is configured to receive water from a water supply source (a water discharger) located inside the cabinet or a water supply source located outside the cabinet.

Further, the present disclosure may realize the laundry treating apparatus and the method for controlling the laundry treating apparatus, wherein when an amount of water (condensate water) generated when air passes through the heat exchanger during drying is lower than an amount of cleaning water required for cleaning the filter assembly or the heat exchanger, the laundry treating apparatus is configured to guide a user to supply the cleaning water.

Further, the present disclosure may realize the laundry treating apparatus and the method for controlling the laundry treating apparatus, wherein when an amount of condensate water generated during drying is lower than an amount of cleaning water required for cleaning the filter assembly or the heat exchanger, the laundry treating apparatus is configured to forcibly prevent a user from discarding condensate water generated during drying so that the filter assembly or the heat exchanger must be cleaned during subsequent drying.

Further, the present disclosure may realize the laundry treating apparatus and the method for controlling the laundry treating apparatus, wherein the laundry treating apparatus is configured to predict an amount of condensate water that may be generated during a drying operation before initiation of the drying operation, and when the predicted amount of the condensate water is lower than an amount of cleaning water required for cleaning the filter assembly or the heat exchanger, the apparatus is configured to guide the user to supply the cleaning water.

BEST MODE FOR CARRYING OUT THE INVENTION

Figure 1:
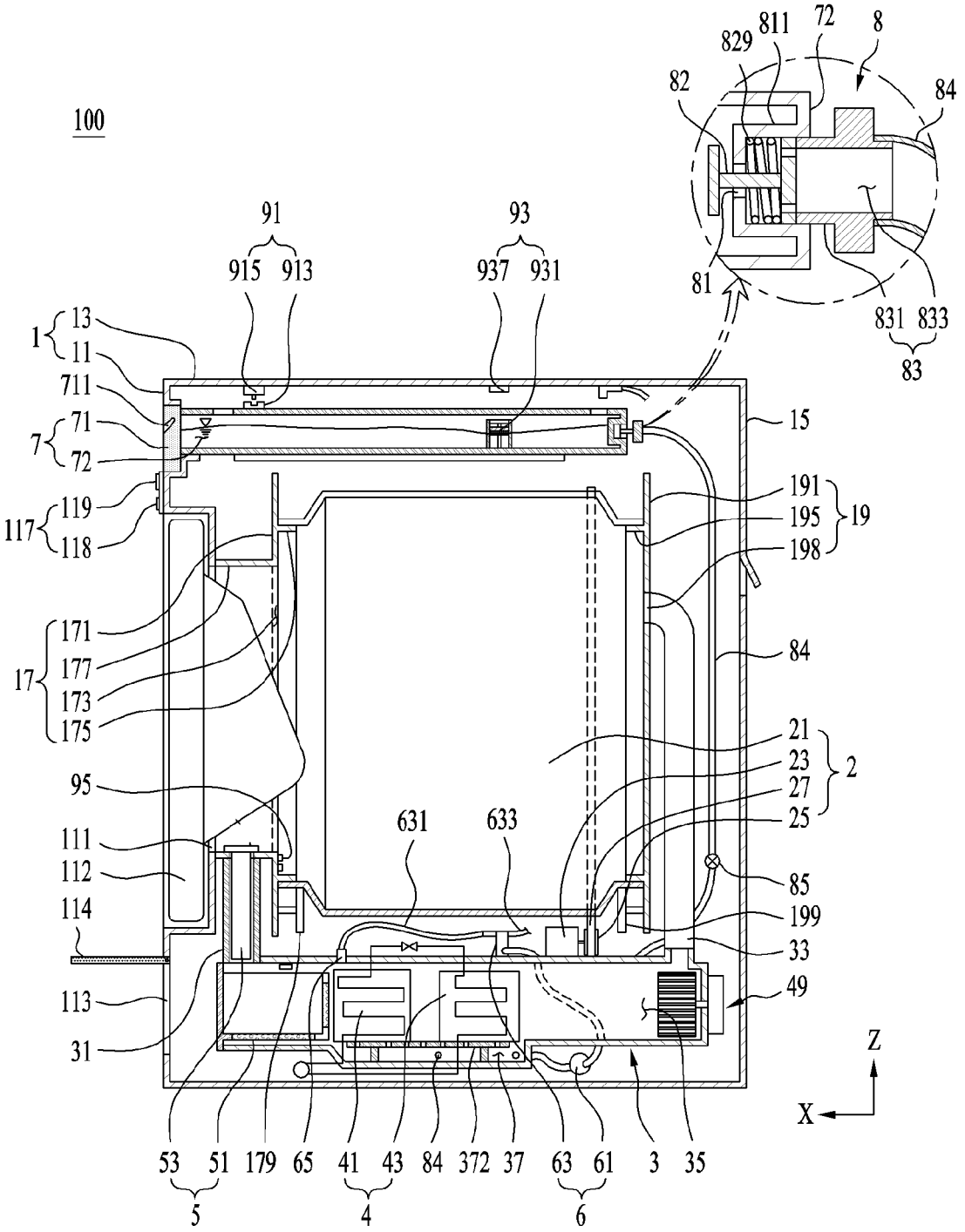
FIG. 1 shows an example of a laundry treating apparatus.

Hereinafter, preferred embodiments of a laundry treating apparatus and a control method thereof may be described in detail with reference to the accompanying drawings. A configuration or a control method of an apparatus to be described below are intended only for describing examples of an laundry treating apparatus and a control method thereof, and is not intended to limit a scope of the disclosure. The same reference numerals throughout the specification represent the same elements.

FIG. 1 shows one example of a laundry treating apparatus 100. The laundry treating apparatus 100 may include a cabinet 1, a drum rotatably received in the cabinet and having a laundry storage space therein, a duct 3 that defines a channel for resupplying air discharged from the drum 2 to the drum 2, and a heat exchanger 4 that dehumidifies and heats air introduced into the duct 3 and then resupplies the same to the drum 2.

The cabinet 1 may be configured to include a front panel 11 defining a front face of the laundry treating apparatus, a rear panel 15 defining a rear face of the laundry treating apparatus, and a top panel 13 defining a top face of the laundry treating apparatus.

The front panel 11 has a cabinet laundry inlet 111 defined therein and constructed to communicate with the drum 2. The cabinet laundry inlet 111 may be constructed to be opened and closed by a door 112 pivotably coupled to the cabinet.

A control panel 117 may be disposed on the front panel 11. The control panel 117 may include an input interface 118 for receiving a control command from a user and a display 119 for outputting information such as a control command selectable by the user.

The input interface 118 may include a power supply request unit that requests power supply to the laundry treating apparatus, a course input interface that enables a user to select a desired course from among a plurality of courses, and an execution request unit that requests initiation of a course selected by the user. The display 119 may include at least one of a display panel capable of outputting texts and figures, and a speaker capable of outputting audio signals and sounds.

When the drum 2 is embodied as a cylindrical drum body 21 with open front and rear faces, the cabinet 1 may contain a first support 17 rotatably supporting a front face of the drum 2, and a second support 19 rotatably supporting a rear face of the drum 2.

The first support 17 may include a first fixed body 171 fixed disposed inside the cabinet 1, a drum laundry inlet 173 constructed to pass through the first fixed body and to communicate the cabinet laundry inlet 111 with an inside of the drum body 21, and a first support body 175 disposed on the first fixed body 171 and inserted into a front face (a first opening) of the drum body 21.

The first fixed body 171 may have any shape as long as the drum laundry inlet 173 is defined therein and the first support body 175 is disposed thereon. The first support body 175 may be embodied as a pipe shape protruding from the first fixed body 171 toward the drum body 21. A diameter of the first support body 175 may be larger than a diameter of the drum laundry inlet 173 and may be smaller than a diameter of the front face of the drum body 21. In this case, the drum laundry inlet 173 may be located inside a space defined by the first support body 175.

Figure 2:
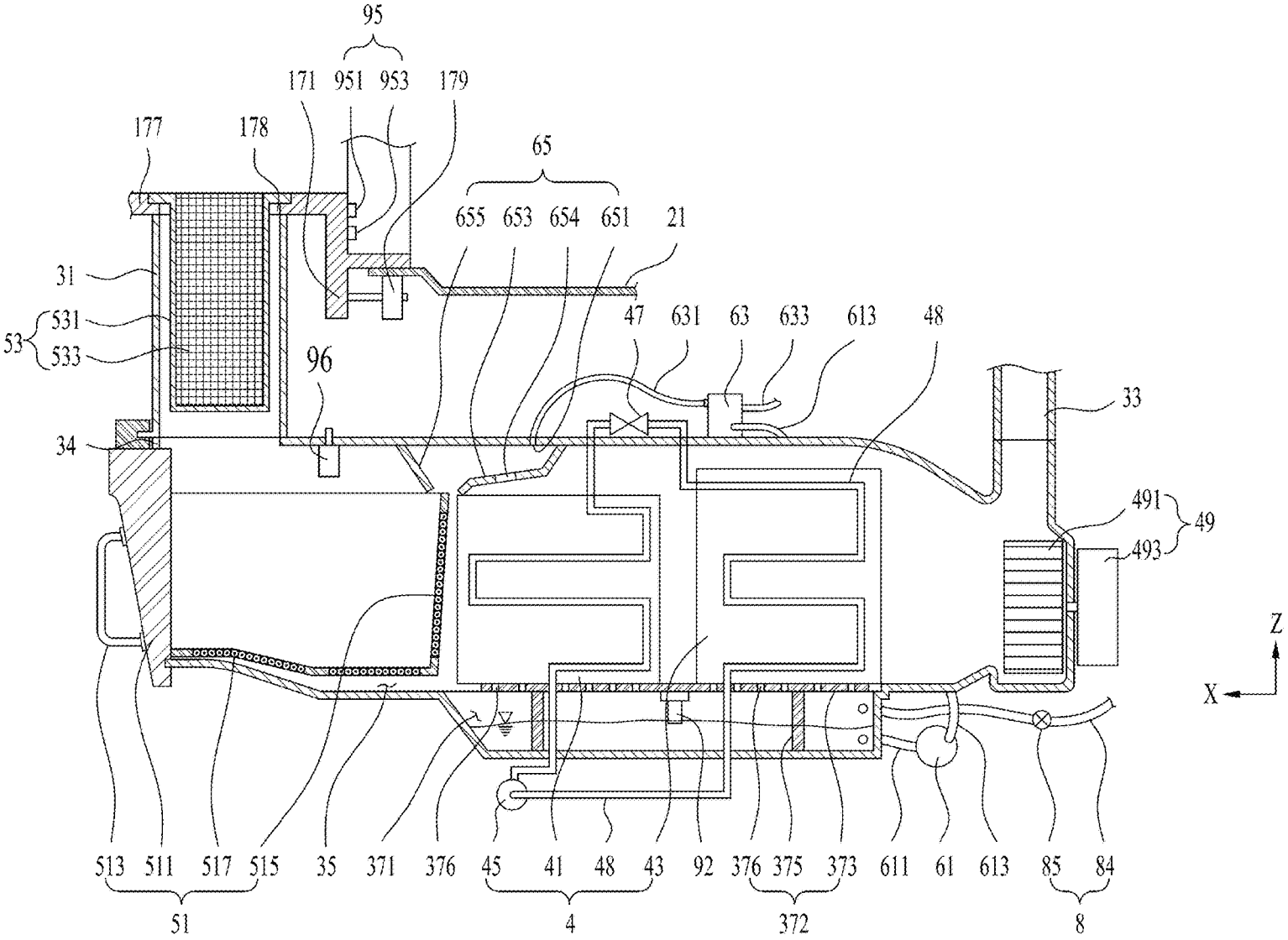
FIG. 2 shows an example of a heat exchanger and cleaner disposed in a laundry treating apparatus.

The first support 17 may be constructed to further include a connection body 177 connecting the cabinet laundry inlet 111 and the drum laundry inlet 173 with each other. The connection body 177 may be embodied as a pipe shape extending from the drum laundry inlet 173 toward the cabinet laundry inlet 111. The connection body 177 may have an air outlet 178 defined therein that communicates with the duct 3. As shown in FIG. 2, the air outlet 178 refers to a passage that allows air inside the drum body 21 to move to the duct 3 therethrough, and may be embodied as a through-hole defined to pass through the connection body 177.

As shown in FIG. 1, the second support 19 may include a second fixed body 191 disposed fixedly inside the cabinet 1 and a second support body 195 disposed on the second fixed body 191 and inserted into a rear face (a second opening) of the drum body 21. The second support 19 may have an air inlet 198 defined therein to pass through the second fixed body 191 and communicate the inside of the drum body 21 with the inside of the cabinet 1. In this case, the duct 3 may be constructed to connect the air outlet 178 and the air inlet 198 to each other.

The cylindrical drum body 21 having an empty inner space defined therein may rotate via various types of drivers. FIG. 1 illustrates one example where the driver may be configured to include a motor 23 disposed fixedly inside the cabinet 1, a pulley 25 rotated by the motor, and a belt 27 connecting a circumferential surface of the pulley 25 and a circumferential surface of the drum body 21 with each other.

In this case, the first support 17 may include a first roller 179 rotatably supporting a circumferential surface of the drum body 21. The second support 19 may have a second roller 199 that rotatably supports a circumferential surface of the drum body.

The duct 3 may be configured to include a discharge duct 31 connected to the air outlet 178, a supply duct 33 connected to the air inlet 198, and a connection duct 35 connecting the discharge duct and the supply duct with each other.

The heat exchanger 4 may be embodied as a variety of devices capable of sequentially performing dehumidification and heating of the air introduced into the duct 3.

FIG. 2 illustrates one example where the heat exchanger is embodied as a heat pump.

The heat exchanger 4 shown in FIG. 2 may include a fan 49 that moves air along the duct 3, a first heat exchanger (heat-absorber) 41 that removes moisture from the air flowing into the duct 3, and a second heat exchanger (heat-emitter) 43 disposed inside the duct 3 to heat air passing through the first heat exchanger 41.

The fan 49 may be configured to include an impeller 491 disposed inside the duct 3 and an impeller motor 493 rotating the impeller 491. The impeller 491 may be disposed in any one of the discharge duct 31, the connection duct 35, and the supply duct 33. FIG. 2 illustrates one example where the impeller 491 is installed in the supply duct 33 (is located in rear of the heat-emitter).

The heat-absorber 41 may be embodied as a plurality of metal plates arranged along a Y-axis direction (in a width direction of the connection duct 35) or a Z-axis direction (in a height direction of the connection duct). The heat-emitter 43 may be embodied as a plurality of metal plates arranged along the width direction of the connection duct or the height direction of the connection duct. The heat-absorber 41 and the heat-emitter 43 may be sequentially arranged in the connection duct 35 in a direction from the discharge duct 31 to the supply duct 33, and may be connected to each other through a refrigerant pipe 48 that defines a circulation channel of refrigerant.

The refrigerant may flow along the refrigerant pipe 48 by a compressor 45 located outside the duct 3. A pressure adjuster 47 may be disposed at the refrigerant pipe 48 to control a pressure of the refrigerant that has passed through the heat-emitter 43.

The heat-absorber 41 may refer to means to cool the air and evaporate the refrigerant by transferring heat of the air flowing into the discharge duct 31 to the refrigerant. The heat-emitter 43 may refer to means for heating the air and condensing the refrigerant by transferring heat from the refrigerant that has passed through the compressor 45 to the air. In this case, moisture contained in the air may be collected on a bottom face of the connection duct 35 along a surface of the heat-absorber 41 as the air passes through the heat-absorber 41.

A water collector 37 may be disposed in the laundry treating apparatus 100 to collect water removed from the air passing through the heat-absorber 41. FIG. 2 shows an example where the water collector 37 is located inside the connection duct 35.

The water collector 371 and 372 in FIG. 2 may include a water collector body 371 that is fixed to a bottom face of the connection duct 35 and communicates with the inside of the connection duct. To prevent the heat-absorber 41 and the heat-emitter 43 from contacting water (condensate water) stored in the water collector body 371, a heat exchanger support 372 may be further disposed inside the water collector body 371. The heat exchanger support 372 may be configured to include a support plate 373 with which the heat-absorber 41 and the heat-emitter 43 are in contact, a pacer 375 to maintain a space between the support plate 373 and a bottom face of the water collector body 371, and a support plate through-hole 376 constructed to pass through the support plate 373.

The support plate through-hole 376 may be defined only in a portion of the support plate 373 on which the heat-absorber 41 is supported, or may be defined in a portion thereof on which the heat-absorber is supported and a portion thereof on which the heat-emitter is supported. When the support plate through-hole 376 is defined under the heat-emitter 43, water transferred to the heat-emitter 43 along the support plate 373 may be discharged to the water collector body 371 (thus, preventing decrease in heat transfer efficiency that may otherwise occur when the heat-emitter contacts the water).

In order to minimize accumulation of contaminants (lint) discharged from the drum body 21 on the heat-absorber 41 and the heat-emitter 43, a filter assembly for filtering air may be further disposed in the laundry treating apparatus 100. FIG. 2 illustrates one example where the filter assembly includes a first filter assembly 51 disposed in the connection duct 35 and a second filter assembly 53 disposed in the discharge duct 31.

The second filter assembly 53 may be embodied as means for filtering air flowing from the drum body 21 into the discharge duct 31. The first filter assembly 51 may be disposed between the second filter assembly 53 and the heat-absorber 41 and may be embodied as means for filtering air that has passed through the second filter assembly.

The first filter assembly 51 may be detachably disposed in the connection duct 35. In this case, a filter insertion hole 113 (refer to FIG. 1) through which the first filter assembly 51 is drawn out may be defined in the front panel 11 of the cabinet, and an insertion hole door 114 to open and close the filter insertion hole may be disposed thereon. The duct 3 may have a duct through-hole 34 (refer to FIG. 2) defined therein into which the first filter assembly 51 is inserted. Therefore, the user may separate the first filter assembly 51 from the laundry treating apparatus and remove the contaminants remaining in the first filter assembly 51 and clean the second filter assembly, when necessary.

As shown in FIG. 2, the first filter assembly 51 may include a first frame 511 inserted into the duct through-hole 34 and positioned between the second filter assembly 53 and the heat-absorber 41, and filters 515 and 517 that are disposed in the first frame and filter fluids (air and water) moving to the heat-absorber 41 and the water collector body 371.

The first frame 511 may be implemented in various forms depending on a shape of a cross-section (Y-Z plane and X-Z plane) of the connection duct 35. FIG. 2 shows an example where the first frame 511 has a shape similar to a hexahedron.

In this case, an air inlet may be defined in a top face of the first frame 511 to introduce air that has passed through the second filter assembly 53 into an inside of the first frame 511. A handle 513 protruding toward the filter insertion hole 113 may be disposed on a front face of the first frame 511. The filters 515 and 517 may include a first filter 515 disposed on a rear face of the first frame 511 and a second filter 517 disposed on a bottom face of the first frame 511. The rear face of the first frame refers to a face of the first frame 511 facing toward the heat-absorber 41. The bottom face of the first frame may refer to a face thereof facing toward a bottom face of the connection duct 35 and may be defined as a face facing toward the air inlet.

The second filter assembly 53 may include a second frame 531 that is detachably inserted into the discharge duct 31 through the air outlet 178, and a third filter 533 that is disposed in the second frame to filter air. A diameter of a filter hole defined in each of the first filter 515 and the second filter 517 may be set to be smaller than a diameter of a filter hole defined in the third filter 533.

As shown in FIG. 1, the laundry treating apparatus 100 may further include a cleaner 6 which uses the water stored in the water collector body 371 to clean the first filter assembly 51, and a water discharger 7 which discharges the water inside the water collector body 371 to an outside of the water collector body 371.

As shown in FIG. 2, the cleaner 6 may be embodied as means for cleaning at least one of the first filter 515, the second filter 517, and the heat-absorber 41 by ejecting the water stored in the water collector body 371 into the first filter assembly 51. The cleaner 6 may be configured to include a water ejector 65 that is disposed at the duct 3 and supplies water to the first filter assembly 51, and a pump 61 that moves water stored in the water collector body 371 to the water ejector 65.

The pump 61 may be connected to the water collector body 371 through a first connection pipe 611, and may be connected to the water ejector 65 through a second connection pipe 613. When the laundry treating apparatus 100 is configured to move the water from the water collector body 371 to the water ejector 65 and the water discharger 7 using only a single pump 61, the laundry treating apparatus 100 may further include a channel switch 63. In this case, the channel switch 63 may be connected to the pump 61 through the second connection pipe 613. The water ejector 65 may be connected to the channel switch 63 through a water ejector supply pipe 631. The water discharger 7 may be constructed to be connected to the channel switch 63 through a water discharger supply pipe 633.

The channel switch 63 may include a valve that controls opening and closing of the water ejector supply pipe 631 and a valve that controls opening and closing of the water discharger supply pipe 633. Therefore, the laundry treating apparatus 100 may control the valves disposed in the channel switch 63 such that the water stored in the water collector body 371 may be supplied to the water ejector 65 or the water discharger 7.

The water ejector 65 may be embodied as nozzles which may be fixed to the connection duct 35 and ejects water to the first filter 515 and the second filter 517, respectively, or may be embodied as nozzles for ejecting water to the first filter 515, the second filter 517, and a front face of the heat-absorber 41, respectively.

FIG. 2 shows one example where the water ejector 65 includes a duct through-hole 651 passing through the connection duct 35, and connected to the water ejector supply pipe 631, a first guide 653 which guides water supplied from the duct through-hole to the first filter 515, and a second guide 655 constructed to guide at least a portion of the water supplied through the first guide 653 to a front face of the heat-absorber 41. In this case, the second guide 655 may be embodied as means for supplying water to the front face of the heat-absorber 41 through the first filter 515. That is, the first filter 515 may be positioned between the first guide 653 and the second guide 655 when the first filter assembly 51 is fixed to the connection duct 35. The second guide 655 may be embodied as an inclined face inclined downward from a top face of the connection duct 35 toward the first filter 515.

A guide through-hole 654 may be further defined in the first guide 653. The guide through-hole 654 may refer to a hole passing through the first guide 653. Thus, the water introduced into the duct through-hole 651 may be supplied to a front region of the heat-absorber 41 through the guide through-hole 654. The front region of the heat-absorber refers to a region thereof facing toward the first filter 515 in a vertical line passing through a center of the heat-absorber 41.

Figure 3:
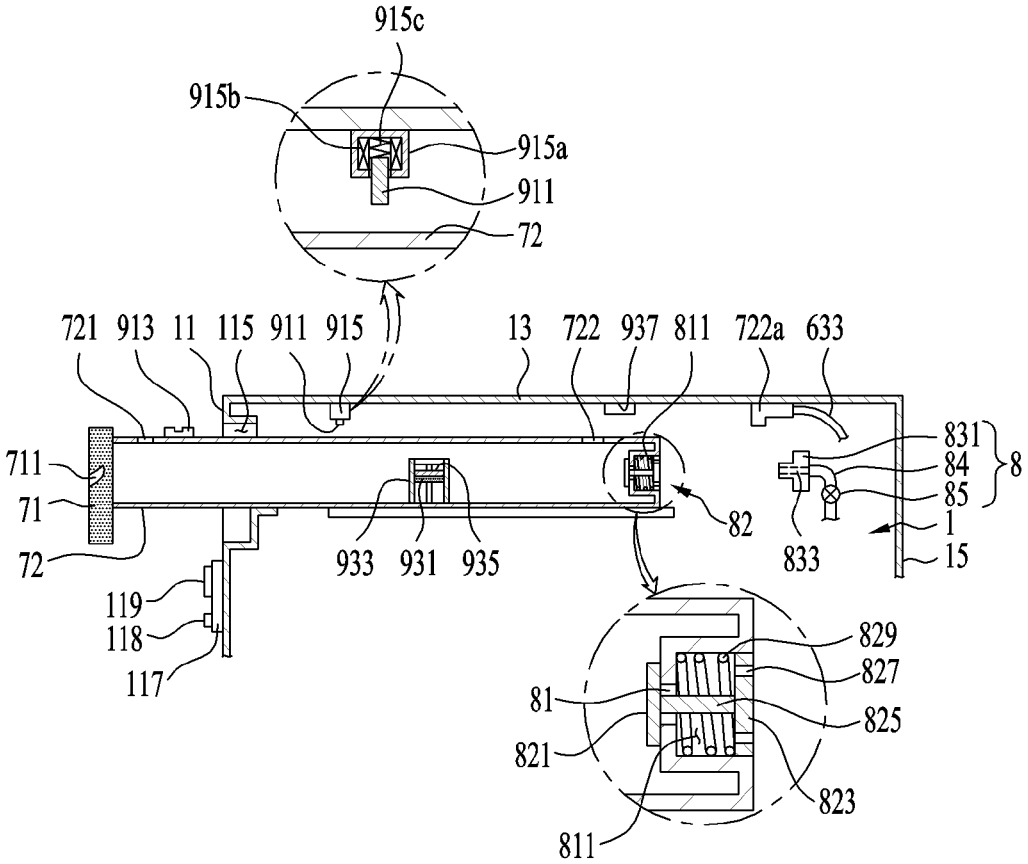
FIG. 3 shows an example of a water discharger and a water supplier provided in the laundry treating apparatus.

As shown in FIG. 3, the water discharger 7 may include a water storage body 72 that is detachably disposed on the cabinet 1 and had a space defined therein for storing water, and an inlet 722 constructed to pass through the water storage body 72 and to introduce water discharged from the water discharger supply pipe 633 into the water storage body 72.

The water storage body 72 may be embodied as a drawer-type tank which may extend or retract from or into the cabinet 1. In this case, a water discharger insertion hole 115 into which the water storage body 72 is inserted should be defined in the front panel 11 of the cabinet. A panel 71 may be fixed to a front face of the water storage body 72. The panel 71 may be constructed to be detachably coupled to the water discharger insertion hole 115 to define a portion of the front panel 11.

A groove 711 into which a user's hand is inserted may be further defined in the panel 71. In this case, the panel 71 may act as a handle to allow the user to pull the water storage body 72 out of the cabinet or insert the same into the cabinet.

The inlet 722 may be constructed to receive water discharged from the nozzle **722*a* fixed to the cabinet 1. A nozzle 722*a* may be fixed to the top panel 13 of the cabinet so that the nozzle is positioned above the inlet 722 when the water storage body 72 is inserted into the cabinet 1. In this case, the water discharger supply pipe 633 should be constructed to connect the nozzle 722*a* and the channel switch 63** with each other.

The water discharger 7 having the above structure may be configured such that the user pulls the water storage body 72 out of the cabinet 1 and then flips or tilts the water storage body 72 toward the inlet 722 such that the water inside the water storage body 72 may be discarded. A communication hole 721 may be constructed to pass through a top face of the water storage body 72 so that the water inside the water storage body 72 is easily discharged through the inlet 722.

The laundry treating apparatus 100 as described above has an effect of cleaning the first filter assembly 51 and the heat-absorber 41 using the water stored in the water collector body 371 during operation of the heat exchanger 4. However, when an amount of water stored in the water collector body 371 is small, cleaning of the first filter assembly 51 and the heat-absorber 41 may not be performed reliably. This is because of as follows: when an amount of laundry input to the drum body 21 is small, the amount of water collected in the water collector body 371 during the operation of the heat exchanger 4 may be small. When the amount of water stored in the water collector body is small, the water ejector 65 may not be able to supply enough water to clean the first filter assembly 51 and the heat-absorber 41.

To solve the above-described problem, the laundry treating apparatus 100 may further include a water supplier 8 that guides the water inside the water storage body 72 to the water collector body 371.

As shown in FIG. 3, the water supplier 8 may be configured to include a water discharge hole 81 constructed to discharge the water inside the water storage body 72 to the outside thereof, a water discharge valve 82 constructed to open and close the water discharge hole 81, a valve actuator 83 which opens the water discharge hole 81 by actuating the water discharge valve 82 when the water storage body 72 is fixed to the cabinet 1, a water supply pipe 84 which guides the water discharged from the water discharge hole 81 to the water collector body 371, and a water supply valve 85 that opens or closes the water supply pipe 84 according to a control signal of a controller (not shown).

The water supply pipe 84 may be embodied as a pipe directly connecting the water storage body 72 and the water collector body 371 to each other. That is, the water supply pipe 84 may be embodied as a pipe having one end connected to the water discharge hole 81 and the other end directly connected to the water collector body 371.

Unlike a manner as shown in the drawing, the water supply pipe 84 may be constructed to discharge water to a top of the heat-absorber 41 or the heat-emitter 43 to supply water to the water collector body 371. In this case, the water discharged from the water supply pipe 84 may pass through the heat-absorber or the heat-emitter and then move to the water collector body 371 through the support plate through-hole 376. An approach in which water moves to the water collector body 371 through the heat-absorber 41 or the heat-emitter 43 has an advantageous effect in that the heat-absorber 41 or the heat-emitter 43 may be cleaned when replenishing the water into the water collector body 371. Therefore, when necessary, the water supply pipe 84 may be constructed to directly connect the water storage body 72 and the water collector body 371 to each other and may be constructed to discharge water to a top of the heat-absorber or the heat-emitter.

However, in the approach in which the water moves to the water collector body 371 through the heat-absorber 41 or the heat-emitter 43, it may take a long time to supply water into the water collector body 371 (it may take a long time for water to pass through the heat-absorber or the heat-emitter). Further, when water remains on a surface of the heat-absorber or the heat-emitter (when contaminants remaining in the heat exchanger absorb water), a larger amount of water may be required to supplement the cleaning water into the water collector body 371. Therefore, in order to shorten a time taken to supply water to the water collector body 371, and to minimize the water amount required for replenishment of the water collector body, an approach in which the water supply pipe 84 directly connects the water storage body 72 and the water collector body 371 to each other would be desirable.

The water storage body 71 may have a fastener 811 defined in a rear face thereof and embodied as a concave bent groove recessed toward the panel 71. The water discharge hole 81 may be embodied as a through-hole defined inside the fastener 811, constructed to pass through the water storage body 71.

The water discharge valve 82 may include a first valve body 821 which is located inside the water storage body 72 and closes the water discharge hole 81, a second valve body 823 located inside the fastener 811, a body connection bar 825 which is inserted into the water discharge hole 81 and connects the first valve body 821 and the second valve body 823 to each other, a valve body through-hole 827 constructed to pass through the second valve body 823, and a spring 829 disposed on the fastener 811 to generate a force that pushes the second valve body 823 in a direction away from the water discharge hole 81 (a direction in which a state in which the first valve body 821 closes the water discharge hole is kept).

The valve actuator 83 may be configured to include a fastening body 831 inserted into the fastener 811 to actuate the water discharge valve 82, and a body through-hole 833 constructed to pass through the fastening body. The fastening body 831 may have a shape that may be inserted into the fastener 811 when the water storage body 72 is inserted into the cabinet 1.

As shown in FIG. 1, the fastening body 831 pushes the second valve body 823 toward the water discharge hole 81 when the water storage body 72 is inserted into the cabinet 1. When the second valve body 823 moves toward the water discharge hole 81, the first valve body 821 opens the water discharge hole 81. Thus, water drained into the fastener 811 through the water discharge hole 81 may flow through the valve body through-hole 827 to the body through-hole 833. Since the body through-hole 833 is connected to the water collector body 371 through the water supply pipe 84, the laundry treating apparatus 100 may control the water supply valve 85 to supply water from the water storage body 72 to the water collector body 371.

Due to the above-described water supplier 8, the water discharger 7 may act as a water supply source (as disposed in laundry treating apparatus) that supplies water to the water collector 37 as well as means to allow the user to discharge the water collected in the water collector 37.

Although not shown in the drawing, the water supplier 8 may include a water supply source connection pipe connecting the water supply source located outside the cabinet and the water collector body 371 to each other, and a connection pipe valve to open or close the water supply source connection pipe according to a control signal of the controller.

The water discharger 7 may further include a water discharger water-level sensor 93 that detects a water-level of the water storage body 72. As shown in FIG. 3, the water discharger water-level sensor 93 may include a floater 931 that moves up or down along the Z-axis direction (in a height direction of the water storage body) based on the water-level inside the water storage body 72, a permanent magnet 935 fixed to the floater, and a magnetic force sensor 937 that is disposed outside the water storage body 72 and measures a magnitude of a magnetic force provided from the permanent magnet 935. The magnetic force sensor 937 may be fixed to the cabinet 1 and may be configured to transmit a control signal that varies depending on the magnitude of the magnetic force to the controller (not shown). In order for the floater 931 to be located within a sensing range of the magnetic force sensor 937, a floater guide 933 providing a moving path of the floater may be further disposed inside the water storage body 72. The laundry treating apparatus 100 may use the water discharger water-level sensor 93 to determine an amount of water that is able to be supplied to the water collector 37.

As shown in FIGS. 1 and 2, the laundry treating apparatus 100 may be preferably configured to include a water collector water-level sensor 92 that measures a water-level of the water collector body 371 and transmits the same to the controller. When the water collector water-level sensor 92 is disposed, the laundry treating apparatus may determine a timing of moving the water stored in the water collector body 371 to the water storage body 72, and thus prevent the water from the water collector body 371 from flowing back to the connection duct 35.

The water collector water-level sensor 92 may be embodied as any device that may detect the water-level inside the water collector body 371. FIG. 1 shows an example of a sensor that determines the water-level by detecting a position of a floater that is installed on a bottom face of the water collector body 371 and moves up and down based on the water-level. FIG. 2 shows an example of a sensor embodied as a plurality of electrodes of different lengths (the number of the electrodes as electrically connected to each other may vary according to the water-level).

When the water-level measured via the water collector water-level sensor 92 is lower than a predefined cleaning-related reference water-level, the controller disposed in the laundry treating apparatus may control the water supply valve 85 to move the water from the water storage body 72 to the water collector body 371. Thus, the laundry treating apparatus 100 may be able to minimize a problem that the first filter assembly or the heat-absorber is not cleaned due to lack of the water in the water collector body 371.

The laundry treating apparatus 100 as described above may determine whether it is necessary to move the water stored in the water discharger 7 to the water collector 37, using only the water collector water-level sensor 92, and may control an operation timing and an operation duration of the water supply valve 85 that opens and closes the water supply pipe 84, thereby to control a timing of water supply to the water collector 37 and an amount of water to be supplied to the water collector.

To determine a dryness of laundry to determine an operation stop timing of the heat exchanger 4 based on the dryness, a dryness sensor 95 and 96 may be disposed in the laundry treating apparatus 100. The dryness sensor may be embodied as at least one of an electrode sensor 95 that may be constructed to contact the laundry and an amount of moisture contained in the laundry, and a humidity sensor 96 that may measure humidity of air flowing from the drum 2 to the duct 3.

As shown in FIG. 2, the electrode sensor 95 may be configured to include a first electrode 951 and a second electrode 952 which are fixed to the first fixed body 171 and are capable of contacting the laundry inside the drum body 21. As the dryness increases, the amount of moisture contained in the laundry decreases, such that an electrical resistance of the laundry increases. Thus, the laundry treating apparatus 100 may observe the electrical resistance measured when the two electrodes are connected to each other via laundry to determine the dryness of the laundry.

In one example, as the dryness of laundry increases, an amount of moisture contained in air flowing into duct 3 may decrease. The laundry treating apparatus 100 may also determine the dryness of laundry based on a humidity of air introduced into the duct 3 obtained using the humidity sensor 96.

Although not shown in the drawings, a laundry amount sensor for determining an amount of laundry stored in the drum body 21 may be further disposed in the laundry treating apparatus 100. The laundry amount sensor may be embodied as means for transmitting, to the controller, an amount of current supplied to the motor 23 of the driver in order to rotate the drum body 21 at a constant rotational speed, or may be embodied as means for transmitting, to the controller, the number of rotations of the drum body when supplying a certain magnitude of current to the motor 23 for a certain time duration.

As shown in FIG. 3, the laundry treating apparatus 100 may further include a lock 91 that prevents the water storage body 72 from being withdrawn from the cabinet 1. The lock 91 may be configured to include a bar fastener 913 disposed on the water storage body 72, a bar 911 detachably coupled to the bar fastener 913, and actuator 915 disposed on the cabinet 1 to control a position of the bar.

FIG. 3 shows an example where the bar fastener 913 is mounted on a top face of the water storage body 72. Alternatively, the bar fastener 913 may be disposed on a position other than the top face of the water storage body, or may be disposed on the panel 71. The bar fastener 913 may have any shape as long as the bar fastener has a space defined therein into which a free end of the bar 911 is inserted.

The actuator 915 may be embodied as any device as long as the device may control the position of the bar 911. FIG. 3 shows one example where the actuator 915 includes a device including a housing 915*a* fixed to the cabinet, and a coil 915*a* that is disposed inside the housing and generates a magnetic field when current is supplied thereto. In this case, the bar 911 must be embodied as a metal bar. One end of the bar may be coupled to the housing 915*a* while the bar is positioned at a center of the coil 915*a*.

Furthermore, the actuator 915 may further include a spring 915*c* that provides a restoring force to return the bar 911 to an initial position thereof when the current supply to the coil 915*a* is disactivated. The initial position of the bar 911 may be set to a point where the bar is spaced from the bar fastener 913.

When cleaning of the first filter assembly 51 and the heat-absorber 41 is performed in a situation where the water-level of the water collector body 371 is lower than a predefined cleaning-related reference water-level, or when cleaning of the first filter assembly and the heat-absorber is not performed, the lock 91 may be controlled to fix the water storage body 72 to the cabinet 1. This is because using the water generated when the laundry treating apparatus 100 performs a new drying cycle together with the water stored in the water storage body 72 for cleaning of the first filter assembly and the heat-absorber may allow minimizing a possibility that the first filter assembly 51 and the heat-absorber 41 may not be cleaned in a subsequent drying cycle.

Figure 4:
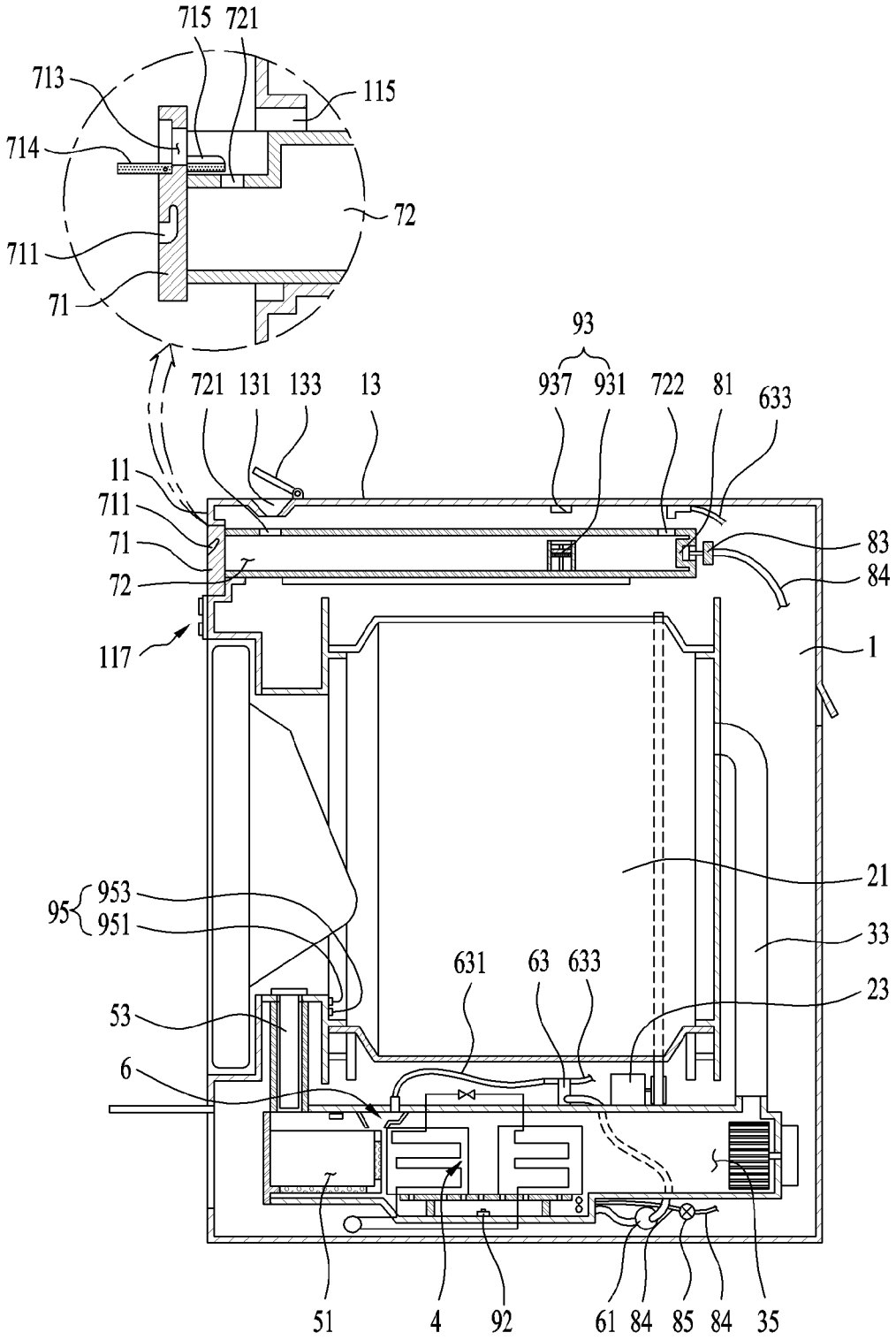
FIG. 4 shows one example of a water storage body water supply hole and a panel water supply hole defined to supply water to a water discharger.

In one example, the laundry treating apparatus 100 may further include a water storage body water supply channel allowing a user to supply water to the water storage body 72. As shown in FIG. 4, the water storage body water supply channel may be defined in the top panel 13 of the cabinet and in the panel 71.

That is, the water storage body water supply channel may be configured to include a water storage body water supply hole 131 constructed to pass through the top panel 13, and a water supply hole door 133 that is rotatably coupled to the top panel to open and close the water storage body water supply hole 131. The water storage body water supply hole 131 may be constructed to be positioned above the communication hole 721 defined in the water storage body when the water storage body 72 has been inserted into the cabinet 1.

The water storage body water supply hole 131 may be defined in a front portion (closer to the laundry inlet) among the front portion and a rear portion of the top panel 13 of the cabinet. This is because water may be more easily supplied to the water storage body 72 when the water storage body water supply hole 131 may be defined in the front portion rather than in the rear portion of the top panel.

Unlike a manner as described above, the water storage body water supply channel may be configured to include a panel water supply hole 713 constructed to pass through the panel 71, and a channel defining portion 715 that guides water flowing into the panel water supply hole 713 to the communication hole 721 defined in the top face of the water storage body. The panel water supply hole 713 may be configured to be opened or closed by a panel door 714 rotatably coupled to the panel.

The water storage body water supply channel may be embodied as a structure different from the structure shown in FIG. 4. That is, when a message requesting supply of cleaning water is displayed on the display 119 disposed on the control panel, the user may extend the water storage body 72 from cabinet 1, and may supply water to the communication hole 721 or the inlet 722. In this case, the water storage body water supply channel may be embodied as the communication hole 721 or the inlet 722.

When the water storage body water supply channel 131 or 713 and 715 as described above is defined in the laundry treating apparatus 100, the lock 91 which prevents the water storage body 72 from being pulled out of the cabinet 1 may not be disposed in the laundry treating apparatus 100.

FIG. 5 to FIG. 8 show examples of a method for controlling the laundry treating apparatus 100 having the above structure. The control methods of FIG. 5 to FIG. 8 have a first common feature that when an amount of water stored in the water collector body 371 is insufficient, the water stored in the water storage body 72 is used, a second common feature that when an amount of the water stored in the water storage body 72 is insufficient to clean the first filter assembly or the heat-absorber, the water storage body 72 is prevented from being drawn out of the cabinet 1.

Figure 5:
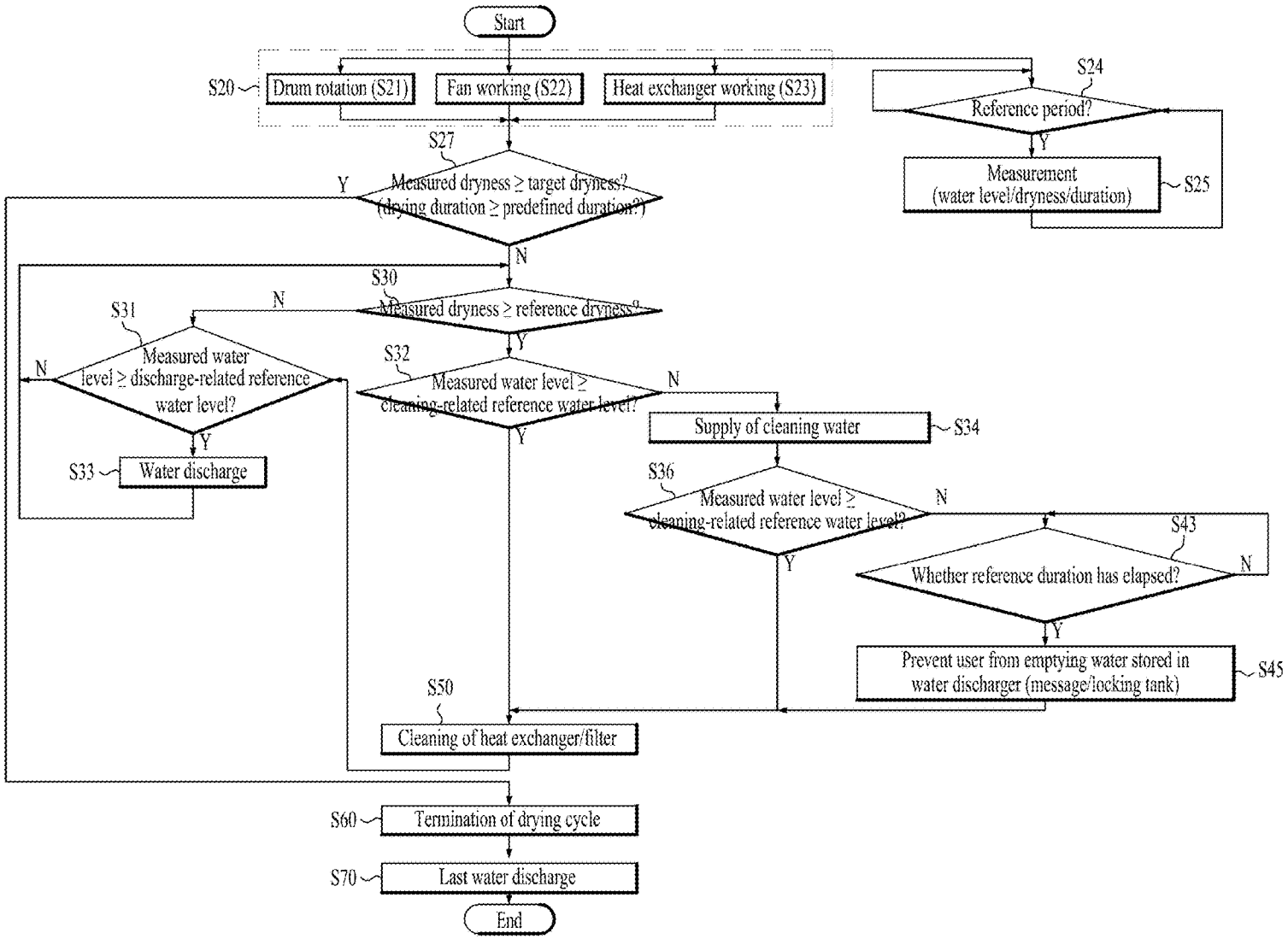
FIG. 5 to FIG. 8 show embodiments of a method for controlling a laundry treating apparatus

The control method of FIG. 5 may be configured to include a drying operation S20 of performing heat exchange between air and laundry inside the drum body 21. The drying operation S20 may be configured to include an operation S21 of rotating the drum body 21 via the motor 23, an operation S22 of operating the fan 49 to circulate air inside the drum body, and an operation S23 of operating the heat exchanger 4.

The operation S22 of operating the fan may refer to a process in which the controller rotates the impeller 491 via the impeller motor 493. The operation S23 of operating the heat exchanger 4 may refer to a process in which the controller operates the compressor 45 and the pressure adjuster 47 to heat exchange between the air introduced into the duct and the refrigerant. During the drying operation S20, the control method may perform a measurement operation S25.

The measurement operation S25 may be configured to include at least one of a dryness sensing operation where the dryness sensors 95 and 96 measure the dryness of laundry, a water collector water-level sensing operation where the water collector water-level sensor 92 measures the water-level of the water collector body 371, a water discharger water-level sensing operation where the water discharger water-level sensor 93 measures the water-level of the water storage body 72, or a duration measurement operation in which a timer (not shown) measures a duration of the drying operation S20. The process of measuring the dryness may be performed using at least one of the electrode sensor 95 or the humidity sensor 96.

The measurement operation S25 may be configured S24 to be executed every time a predefined reference period has elapsed from a time when the drying operation S20 is initiated, and may be configured to be terminated upon termination of the drying operation S20. Unlike a manner as shown in the figure, the measurement operation S25 may be configured to measure the dryness, the water-level, and the duration in real time.

The control method of FIG. 5 may determine whether the dryness of the laundry measured in the measurement operation S25 reaches a predefined target dryness S27. The operation S27 of determining whether the measured dryness has reached the target dryness may be performed in the same period as the reference period.

When it is determined that the dryness measured in the measurement operation S25 has reached the target dryness, the control method of FIG. 5 may terminate the drying operation and the measurement operation S60. The termination operation S60 may be configured to include a process of terminating the rotation of the motor 23, a process of terminating the operation of the fan 49, a process of terminating the operation of the heat exchanger, and a process of terminating the measurement operation. Unlike a manner as described above, the termination operation S60 may be configured to be terminated when a time duration for which the drying operation S20 is performed reaches a predefined target time duration.

When the drying operation is terminated S60, the control method proceeds with a last water discharge operation S70 of transferring the water from the water collector 37 to the water discharger 7 through the water discharger supply pipe 633. That is, the last water discharge operation S70 may refer to a process of controlling the pump 61 and the channel switch 63 such that the water from the water collector body 371 moves to the water storage body 72 along the water discharger supply pipe 633.

In one example, when the dryness measured in the measurement operation S25 has not reached the target dryness, the control method of FIG. 5 may proceed with the operation S30 to determine whether the dryness of laundry has reached a predefined reference dryness. The reference dryness may be set to a dryness lower than the target dryness, and may be set to a dryness at which heat exchange between laundry and air is active.

The reference dryness may be set to a value of 40% to 50% or greater of the target dryness. In a conventional laundry treating apparatus, when the dryness of laundry is 40 to 50% or greater of the target dryness, heat exchange between laundry and air becomes active. When the heat exchange is active, air discharged from the drum body contains a larger amount of contaminants such as lint than air discharged from the drum body at a beginning of a drying operation where heat exchange is not active contains. This may mean that at a timing when a dryness exceeds 40 to 50% of the target dryness, an amount of contaminants supplied to the filter assemblies 51 and 53 and the heat exchanger 4 may increase rapidly. Therefore, the reference dryness may be set to a value of 40% to 50% or greater of the target dryness. When the filter assembly and the heat exchanger are cleaned when a current dryness reaches the reference dryness, deterioration of drying performance (which may increase the duration of the drying operation) as caused by the contaminants remaining in the filter assemblies 51 and 53 and heat exchanger 4 may be minimized.

When the dryness measured in the measurement operation S25 is greater than or equal to the reference dryness, the control method of FIG. 5 may proceed with the water-level sensing operation S32 to determine whether the water-level of the water collector body 371 measured in the measurement operation S25 has reached a predefined cleaning-related reference water-level. When it is determined that the water-level of the water collector body 371 has reached the cleaning-related reference water-level, the control method may perform the cleaning operation S50 of supplying water from the water collector 37 to the water ejector 65.

In the cleaning operation S50, the channel switch 63 may open the water ejector supply pipe 631, and may close the water discharger supply pipe 633. Therefore, when the pump 61 works in the cleaning operation S50, water stored in the water collector body 371 is supplied to the water ejector 65 along the water ejector supply pipe 631.

When the water ejector 65 may be configured to eject water into the first filter 515 of the first filter assembly 51, the cleaning operation S50 may be a process of cleaning the first filter. When the water ejector 65 may be configured to eject water to each of the first filter 515 and the heat-absorber 41, the cleaning operation S50 may be a process of cleaning both the first filter 515 and the heat-absorber 41. In one example, when the water ejector 65 may be configured to eject water to each of the first filter 515, the second filter 517, and the heat-absorber 41, the cleaning operation S50 may be a process of cleaning all of the first filter 515, the second filter 517, and the heat-absorber 41.

When it is determined that the dryness measured in the measurement operation S25 is greater than or equal to the reference dryness, but the water-level of the water collector body 371 is lower than the cleaning-related reference water-level, the control method proceeds with a cleaning water supply operation S34 of transferring the water stored in the water discharger 7 to the water collector 37. In the cleaning water supply operation S34, the controller controls the water supply valve 85 to allow the water from the water storage body 72 to flow to the water collector body 371. When the water storage body 72 is installed at a higher position than a position of the water collector body 371, the water stored in the water storage body 72 may be transferred to the water collector body 371 simply by the water supply valve 85 opening the water supply pipe 84.

When the water storage body 72 is installed at the same vertical level as that of the water collector body 371 or at a lower vertical level than that of the water collector body 371, the water supplier 8 should be configured to further include a water supply pump that moves water from the water storage body 72 to the water collector body 371. In this case, the cleaning water supply operation S34 may be a process of moving water from the water storage body 72 to the water collector body 371 through the water supply pump, the water supply pipe, and the water supply valve.

When the cleaning water supply operation S34 is completed, the control method determines whether the water-level inside the water collector body has reached the cleaning-related reference water-level S36. When the water-level of the water collector body measured after completion of the cleaning water supply operation S36 is greater than or equal to the cleaning-related reference water-level, the control method proceeds with the cleaning operation S50 as described above.

However, when the water-level of the water collector body measured S36 after completion of the cleaning water supply operation is lower than the cleaning-related reference water-level, the cleaning operation S50 is preferably initiated when a predefined reference time duration has elapsed S43 from a timing of a completion of the cleaning water supply operation S36. This is because performing the cleaning operation S50 even when an amount of cleaning water is insufficient is more advantageous because the drying duration is shortened than not performing the cleaning operation S50 is.

In one example, when the water-level of the water collector measured S36 after completion of the cleaning water supply operation is lower than the cleaning-related reference water-level, the control method may be configured to execute at least one of an operation of displaying a message requesting not to empty the water stored in the water storage body 72 on the display 119, or an operation of activating the lock 91 to fix the water storage body 72 to the cabinet 1.

The operation of displaying the message may be performed using at least one of a display panel disposed in the display 1119 or a speaker. When the operation of fixing the water discharger 7 to the cabinet 1 is in progress, the locked state of the water storage body 72 may be released when a sum of the water-level measured by the water discharger water-level sensor 93 and the water-level measured by the water collector water-level sensor 92 during a subsequent drying operation is greater than or equal to the cleaning-related reference water-level.

After completion of the cleaning operation S50, the control method determines whether the water-level of the water collector body 371 has reached a predefined discharge-related reference water-level S31. When the water-level of the water collector body 371 is greater than or equal to the discharge-related reference water-level, the control method may carry out a water discharge operation S33 of controlling the pump 61 and the channel switch 63 such that the water inside the water collector body 371 moves to the water storage body 72. In the water discharge operation S33, the channel switch 63 may close the water ejector supply pipe 631 and may open the water discharger supply pipe 633. Therefore, when the pump 61 operates in the water discharge operation S33, the water from the water collector body 371 may move to the water storage body 72 along the water discharger supply pipe 633.

The discharge-related reference water-level may be set to be equal to the cleaning-related reference water-level, or may be set to be higher than the water-level than the cleaning-related reference water-level. However, when the discharge-related reference water-level is set to be higher than the cleaning-related reference water-level, there may always be water in the water collector body 371 unless a current water level reaches the discharge-related reference water-level. Thus, there is an effect that it is not necessary to proceed with the cleaning water supply operation S34 every time the cleaning operation S50 is performed.

In one example, the water discharge operation S33 may be initiated even when the dryness measured in the measurement operation S25 is lower than the reference dryness, and the water-level measured by the water collector water-level sensor 92 is higher than or equal to the discharge-related reference water-level. This is intended to prevent the water stored in the water collector body 371 from flowing back into the duct 3 (prevent the water inside the water collector body from flowing back to the heat-absorber).

The laundry treating apparatus 100 that implements the above-described control method may not have the water discharger water-level sensor 93. That is, the measurement operation S25 in the present embodiment may be configured not to perform a water discharger water-level sensing operation. This is because under the presence of one water-level sensor 92 disposed at the water collector 37, the water-level of the water collector 37 may be detected, whether the cleaning water supply operation S34 to move the water stored in the water discharger 7 to the water collector 37 is required may be determined, an execution timing of the cleaning water supply operation S34 may be controlled by controlling an operation timing of the water supply valve 85 that opens and closes the water supply pipe 84, and the amount of water to be supplied to the water collector 37 may be controlled by controlling the operation duration of the water supply valve 85.

Figure 6:
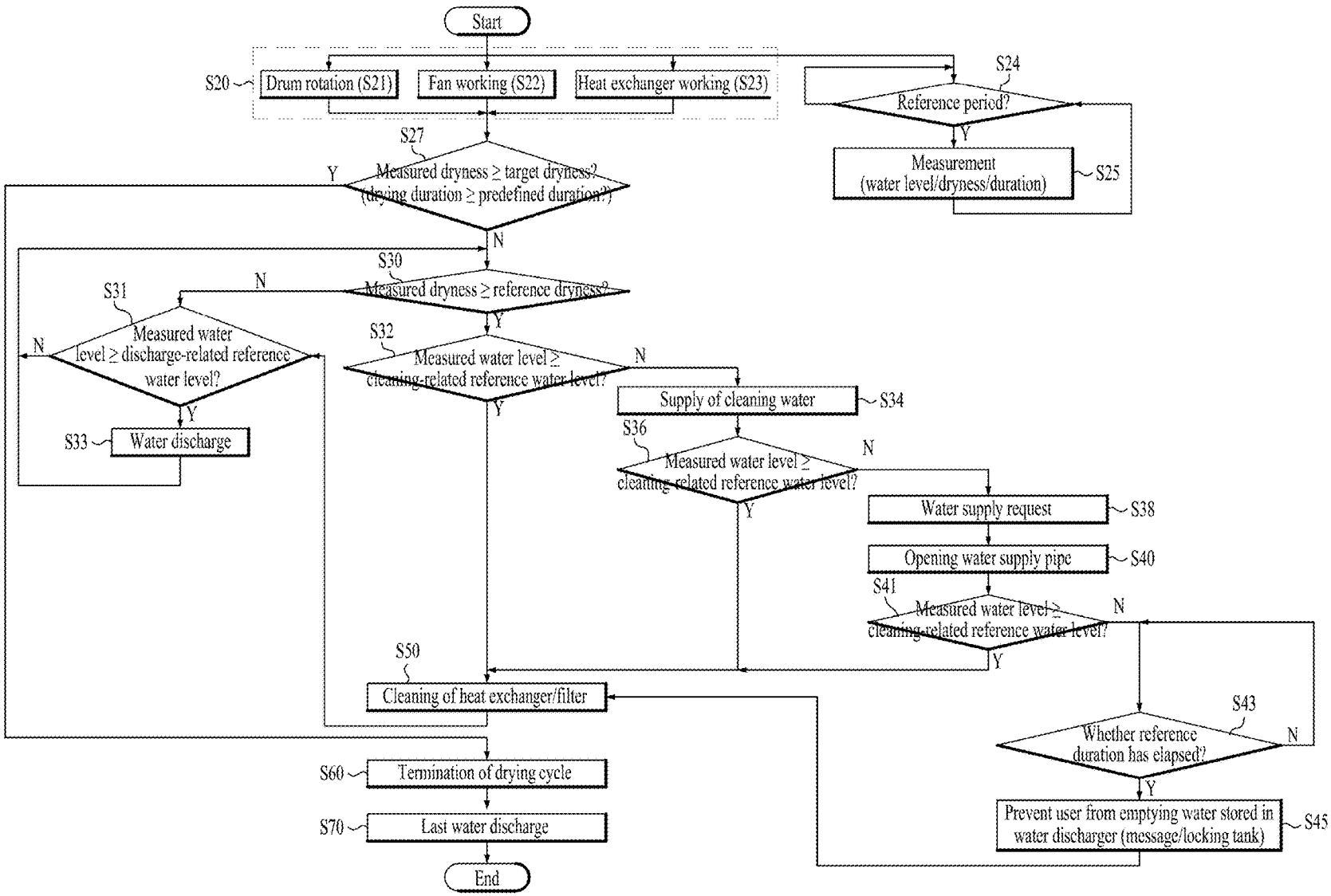

FIG. 6 shows another embodiment of a method for controlling the laundry treating apparatus. A difference between the method of this embodiment and the method of FIG. 5 is that, in this embodiment, when the water-level of the water collector body 371 measured S36 after completion of the cleaning water supply operation is lower than the cleaning-related reference water-level, a notification operation S38 is performed which displays a message requesting that the user should supply water to the water discharger 7 on the display 119.

That is, the drying operation S20, the operations S24 and S25 of measuring the dryness, the water-level, the duration, etc. according to a reference period, the operations S27 and S50 of terminating the drying operation when the dryness of the laundry reaches the target dryness, and the last water discharge operation S70 which proceeds after termination of the drying operation, which constitute the method of FIG. 6 may be the same as described with reference to the method of FIG. 5.

Further, the cleaning operations S30, S32, and S50 which are performed when the dryness of the laundry reaches the reference dryness, and the water-level of the water collector body reaches the cleaning-related reference water-level, and the cleaning water supply operation S34 which is performed when the dryness of the laundry reaches the reference dryness but the water-level of the water collector body does not reach the cleaning-related reference water-level S34 which constitute the method of FIG. 6 may be the same as described with reference to the method of FIG. 5.

In one example, the notification operation S38 in the control method of FIG. 6 may be performed using at least one of the display panel disposed in the display 119 or the speaker. When the water supply request message is displayed on the display 119, the user may extend the water storage body 72 from the cabinet 1, and then the user may supply water to the communication hole 721 or the inlet 722 defined in the water storage body.

After the user supplies the water to the water storage body 72, the user may by insert the water storage body 72 into the cabinet 1 to connect the water storage body 72 to the water supplier 8. When the water storage body 72 is inserted into the cabinet 1, the valve actuator 83 of the water supplier 8 may open the water discharge valve 82 disposed in the water storage body, such that the inside of the water storage body 72 may be connected to the water supply pipe 84.

When the water storage body water supply channel 131, or 713 and 715 as shown in FIG. 4 is defined in the laundry treating apparatus 100, the user may also be able to supply water to the water storage body 72 through the water storage body water supply hole 131 or the panel water supply hole 713 defined in the top panel 13 of the cabinet.

The control method of FIG. 6 may proceed with a connection operation S40 of controlling the water supply valve to open the water supply pipe 84 85 during the notification operation S38 or after completion of the notification operation S38. When the user has supplied water to the water storage body 72, the water inside the water storage body 72 may be transferred to the water collector body 371 through the connection operation S40.

When the connection operation S40 has been completed, the control method of FIG. 6 may determine whether the water-level of the water collector body 371 measured after completion of the notification operation is higher than or equal to the cleaning-related reference water-level S41. When the water-level of the water collector body measured after completion of the notification operation is greater than or equal to the cleaning-related reference water-level S41, the control method of FIG. 6 may initiate the cleaning operation S50.

However, when the water-level of the water collector body measured after completion of the notification operation is lower than the cleaning-related reference water-level S41, the control method of FIG. 6 may be preferably configured to initiate the cleaning operation S50 when the reference time duration has elapsed after the completion of the notification operation S38. This is because performing the cleaning operation S50 even when the amount of the cleaning water is insufficient may shorten the drying duration and thus is more advantageous than not performing the cleaning operation S50.

When the cleaning operation S50 is initiated because the reference time duration has elapsed after the completion of the notification operation S38, the method of FIG. 6 may execute at least one of an operation of displaying a message requesting not to empty the water stored in the water storage body 72 on the display 119, or an operation of activating the lock 91 to fix the water storage body 72 to the cabinet 1.

Figure 7:
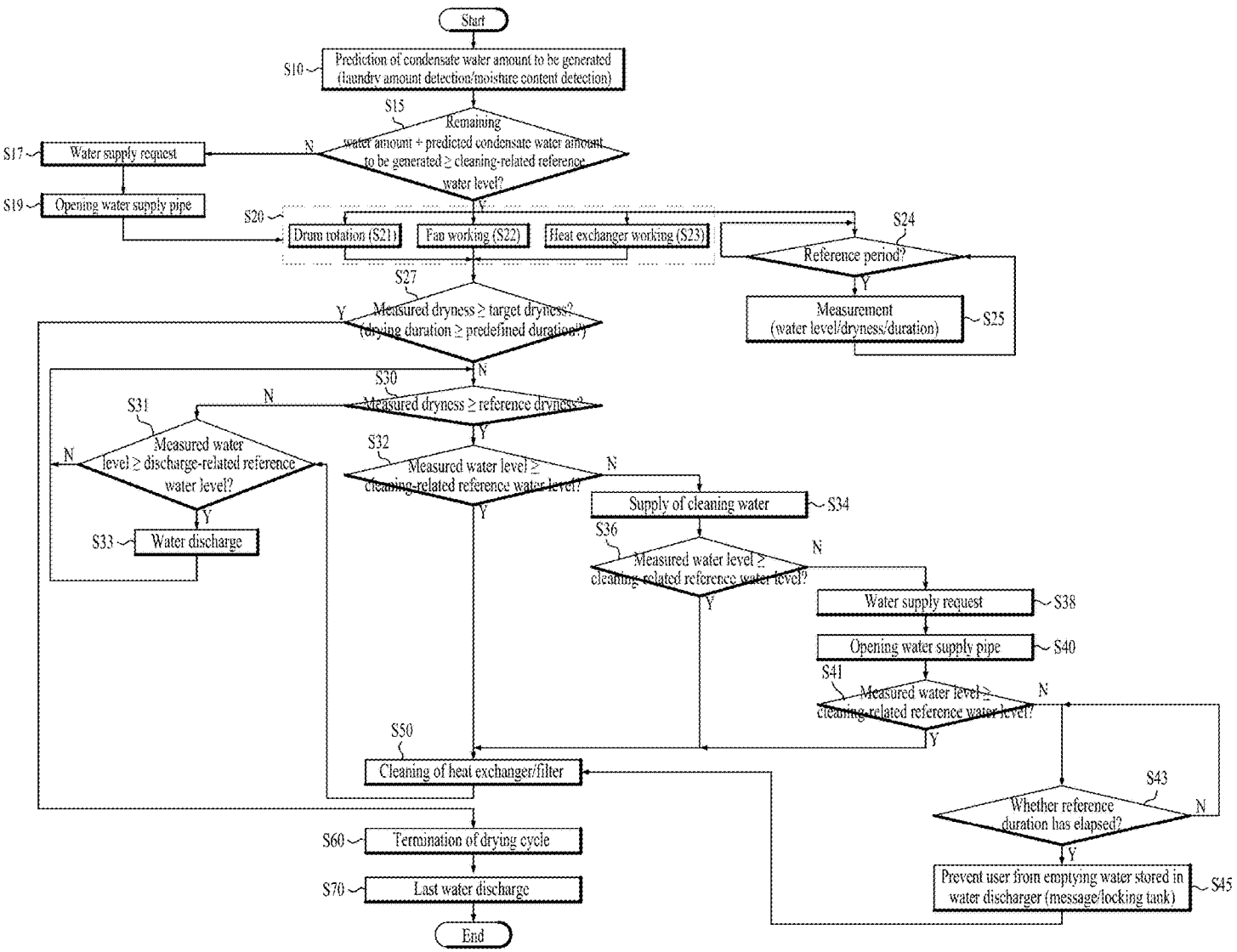

FIG. 7 shows another embodiment of a method for controlling the laundry treating apparatus. A difference between the method of this embodiment and the method of FIG. 6 is that in this embodiment, before the initiation of the drying operation S20, a prediction operation S10 of predicting whether water required for the cleaning operation S50 is collected during the drying operation is further executed.

The prediction operation S10 may include an operation in which the laundry amount sensor determines the amount of laundry (laundry amount) stored in the drum body 21 while the motor 23 of the driver rotates the drum body 21, and an operation in which an amount of collectible water in the water collector body 371 during the drying operation S20 is determined based on the measured laundry amount. The operation in which the amount of collectible water in the water collector body 371 during the drying operation S20 is determined may be performed by the controller comparing an amount of condensate water based on the laundry amount as obtained via experiments with the amount of laundry measured in the laundry amount determination operation.

In one example, because the amount of water contained in laundry may vary depending on a type of laundry (laundry material), the operation in which the amount of collectible water in the water collector body 371 during the drying operation S20 is determined may be configured to predict the amount of condensate water as generated based on the laundry amount and the laundry material. An electrical resistance of laundry that absorbs a lot of water may be lower than that of laundry that absorbs less water. Therefore, when the controller in the laundry treating apparatus may be configured to receive the resistance measured by the electrode sensor 95, the amount of the collectible condensate water may be determined to vary based on the laundry material at the same laundry amount.

The control method of FIG. 7 after completion of the prediction operation S10 may perform a comparison operation S15 of determining whether a sum of the water-level inside the water storage body 72 measured by the water discharger water-level sensor 93 and a water-level corresponding to the predicted amount determined in the prediction operation S10 is greater than or equal to the cleaning-related reference water-level.

When the sum of the water-level inside the water storage body 72 and the water-level corresponding to the predicted amount is greater than or equal to the cleaning-related reference water-level, the control method of FIG. 7 may proceed with the drying operation S20. However, when the sum of the water-level inside the water storage body 72 and the water-level corresponding to the predicted amount is lower than the cleaning-related reference water-level, the control method of FIG. 7 may perform the notification operation S17 (prediction result notification operation) of requesting the user to supply the water to the water storage body 72 on the display 119.

During the prediction result notification operation S17 or after completion of the prediction result notification operation S17, the control method of FIG. 7 may perform the connection operation S19 of controlling the water supply valve 85 to open the water supply pipe 84 to connect the water storage body 72 to the water collector body 371.

Unlike a manner as described above, the comparison operation S15 may be configured to determine whether the sum of the water-level measured by the water discharger water-level sensor 93, the water-level measured by the water collector water-level sensor 92, and the water-level corresponding to the predicted amount determined in the prediction operation S10 is equal to or greater than the cleaning-related reference water-level.

The control process after the drying operation S20 may be the same as that of the control method of FIG. 6. Detailed descriptions thereof are omitted.

Figure 8:
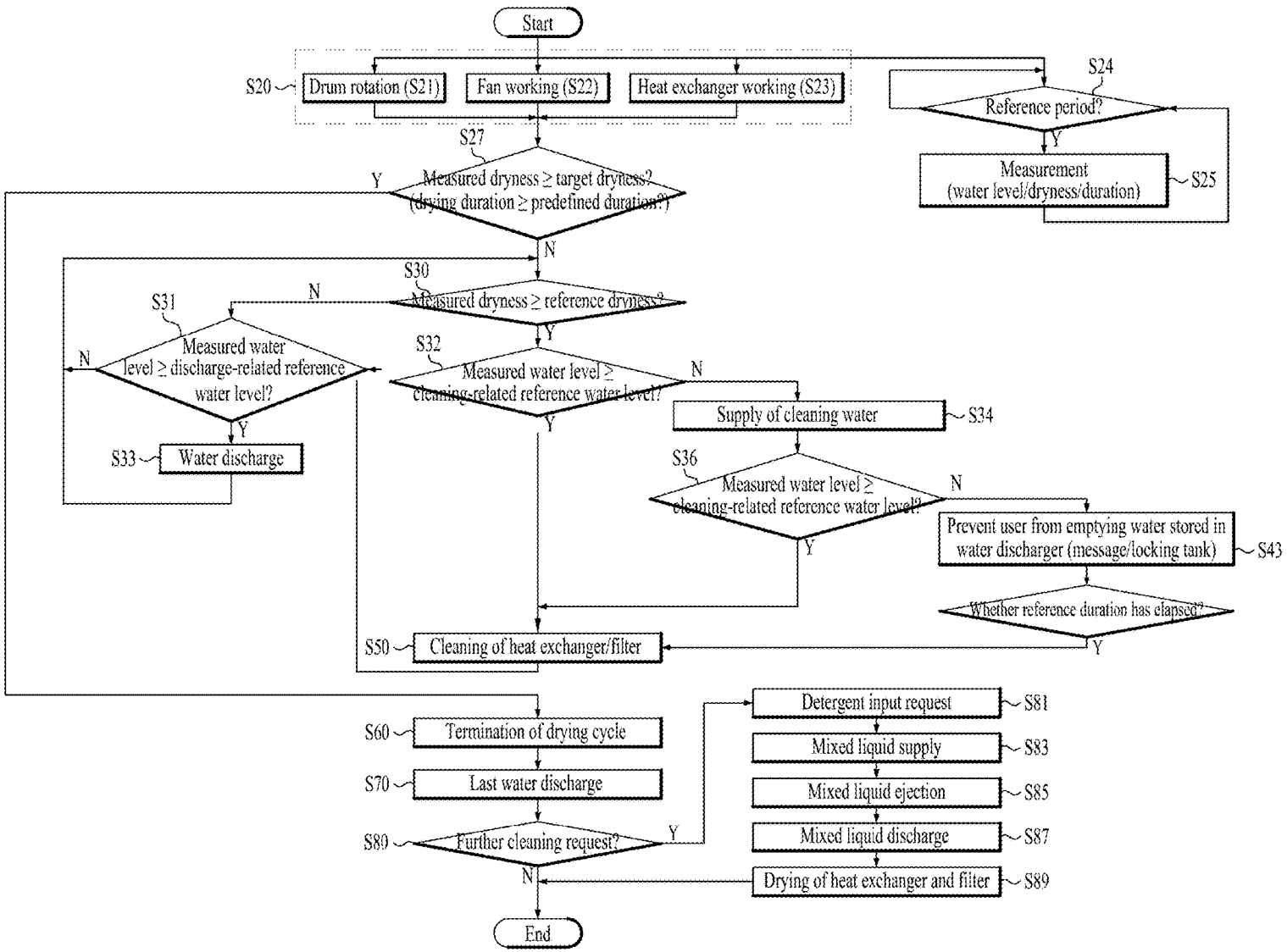

FIG. 8 shows another embodiment of a method for controlling the laundry treating apparatus. A difference between the method of this embodiment and the methods of FIGS. 5 to 6 is that the method of this embodiment may further include additional cleaning operations S80, 581, S83, S85, S87, and S89 of cleaning the first filter assembly 51 and the heat-absorber 41 using detergent according to the user's request.

The control method of FIG. 8 may include, after completion of the last water discharge operation S70, a request check operation S80 of determining whether there is a further cleaning request to the input interface 118. When there is the further cleaning request to the input interface 118, the control method proceeds with a detergent input request operation S81 of displaying a message requesting the input of detergent to the water storage body 72 on the display 119. The user may input the further cleaning request to the laundry treating apparatus via the input interface disposed on the control panel. An input timing of the further cleaning request may be any time before the operation of the laundry treating apparatus is terminated.

In the detergent input request operation S81, the user may extend the water storage body 72 from the cabinet 1 and supply the detergent through the communication hole 721 or the inlet 722. Since the detergent input request operation S81 is initiated after the completion of the last water discharge operation S70, water is stored in the water storage body 72. Therefore, the user may input any type of detergents into the water storage body 72. The types of detergents may include liquid detergent, powder detergent, or capsule detergent (detergent in which a capsule surrounding the detergent dissolves in water over time).

After completion of the detergent input request operation S81, the control method of FIG. 8 may execute sequentially a mixed liquid supply operation S83 of controlling the water supply valve 85 to supply mixed liquid (mixed liquid of water and detergent) in the water storage body 72 to the water collector body 371, a mixed liquid ejection operation S85 of supplying the mixed liquid stored in the water collector body 371 to the water ejector 65 to clean the first filter assembly and the heat-absorber, and a mixed liquid discharge operation S8 of moving the mixed liquid inside the water collector body 371 to the water storage body 72 after the completion of the mixed liquid ejection operation S85.

After completion of the mixed liquid discharge operation S87, the control method of FIG. 8 may perform a duct drying operation S89 of operating the fan 49 to dry the first filter assembly and the heat-absorber. Therefore, the control method may hygienically manage the first filter assembly and the heat-absorber.

Unlike the manner as shown in FIG. 8, the request check operation S80 and the detergent input request operation S81 may be performed before the last water discharge operation S70. The mixed liquid supply operation S83, the mixed liquid ejection operation S85, the mixed liquid discharge operation S87, and the duct drying operation S89 may be performed after the last water discharge operation S70.

According to the laundry treating apparatus and the control method thereof as above-described, when the water-level of the water collector where the condensate water is stored is lower than the water-level required for cleaning of the filter or the heat exchanger, the collector may receive the water from the water supply source (water discharger) located inside the cabinet or the water supply source located outside the cabinet, thereby to minimize the possibility that the filter assembly or the heat exchanger may not be cleaned.

Further, according to the laundry treating apparatus and the control method thereof as above-described, when the amount of condensate water generated during the drying is lower than the amount of cleaning water required for cleaning the filter or the heat exchanger, the apparatus may guide the user to supply the cleaning water, thereby to minimize the possibility that the filter assembly or the heat exchanger may not be cleaned.

Further, according to the laundry treating apparatus and the control method thereof as above-described, when the amount of condensate water generated during the drying is lower than the amount of cleaning water required for cleaning the filter or the heat exchanger, the apparatus may forcibly prevent the user from discarding the condensate water generated during the drying, thereby to achieve an effect that the filter assembly or the heat exchanger is cleaned during a subsequent drying operation.

Although not shown in the drawing, the cleaning operation S50 in the above-described control methods may be configured not to be executed several times during the drying operation S20, but to be executed only once before the termination of the drying operation S20. In this case, the operation S30 in FIG. 5 to FIG. 8 of determining whether the dryness has reached the reference dryness may be modified into an operation of determining whether a current timing has reached a predefined cleaning timing from a time when the drying operation S20 is initiated. The cleaning timing may be set to a timing at which a predefined duration remains before a timing at which the drying operation S20 is terminated. The predefined duration may be set to a duration required to execute the cleaning operation S50 once using the cleaner 6.

The laundry treating apparatus and the method for controlling the laundry treating apparatus as above-described may be modified and implemented in various forms, and the scope of the disclosure is not limited to the above-described embodiments.

The invention claimed is:

1. A method for controlling a laundry treating apparatus, wherein the laundry treating apparatus includes: a drum having a laundry storage space defined therein; a duct defining a channel for supplying air discharged from the drum back to the drum; a fan to move air along the duct; a heat-absorber for removing moisture from air introduced into the duct; a heat-emitter disposed inside the duct to heat air passing through the heat-absorber; a water collector for storing therein water discharged from air passing through the heat-absorber; a filter assembly disposed in the duct to filter air moving to the heat-absorber; a water discharger having a water storage space defined therein; a water discharger supply pipe for supplying water stored in the water collector to the water discharger; a water ejector for ejecting water into the filter assembly; a water ejector supply pipe for supplying water stored in the water collector to the water ejector; a water supply pipe that connects the water discharger and the water collector to each other; a water supply valve configured to control opening and closing of the water supply pipe and to supply water in the water discharger to the water collector; and a water collector water-level sensor for measuring a water-level inside the water collector, the method comprising:

a drying operation in which the fan, the heat-absorber, and the heat-emitter perform heat exchange between air and laundry in the drum;

a water-level sensing operation in which the water collector water-level sensor measures the water-level of the water collector during the drying operation;

a cleaning water supply operation in which when the water-level of the water collector is lower than a predefined cleaning-related reference water-level, the water supply valve is controlled to supply water stored in the water discharger to the water collector; and a cleaning operation in which after completion of the cleaning water supply operation, water is supplied from the water collector to the water ejector to clean the filter assembly.

2. The method of claim 1, wherein each of the cleaning water supply operation and the cleaning operation is initiated when a dryness of laundry measured using at least one of an electrode sensor or a humidity sensor is equal to or greater than a predefined reference dryness, wherein the humidity sensor measures a humidity of air flowing from the drum to the duct, wherein the electrode sensor is configured to contact the laundry and measure an amount of moisture contained in the laundry.

3. The method of claim 2, further comprising:

a termination operation in which when the dryness of the laundry measured by at least one of the humidity sensor or the electrode sensor reaches a target dryness higher than the predefined reference dryness, the drying operation is terminated; and a last water discharge operation in which after the termination of the drying operation, water stored in the water collector flows to the water discharger through the water discharger supply pipe.

4. The method of claim 3, further comprising:

a detergent input request operation in which when a request of cleaning using detergent is input to an input interface receiving a control command from a user after completion of the last water discharge operation, a message requesting detergent input to the water discharger is outputted using at least one of a display panel or a speaker; and a mixed liquid supply operation in which the water supply valve is controlled such that a mixed liquid of water and detergent stored in the water discharger is supplied to the water collector;

a mixed liquid ejection operation in which the mixed liquid stored in the water collector is supplied to the water ejector to clean the filter assembly; and a mixed liquid discharge operation in which the mixed liquid inside the water collector flows to the water discharger after completion of the mixed liquid ejection operation.

5. The method of claim 4, further comprising a filter assembly drying operation in which after completion of the mixed liquid discharge operation, the fan is activated to dry the filter assembly.

6. The method of claim 2, further comprising a water discharge operation in which when the water-level of the water collector measured after completion of the cleaning operation is greater than or equal to a predefined discharge-related reference water-level, water stored in the water collector flows to the water discharger through the water discharger supply pipe.

7. The method of claim 2, further comprising a water discharge operation in which when a dryness of air flowing from the drum to the duct is lower than the predefined reference dryness, and the water-level of the water collector is greater than or equal to a predefined discharge-related reference water-level, water stored in the water collector flows to the water discharger through the water discharger supply pipe.

8. The method of claim 2, wherein when the water-level of the water collector measured after completion of the cleaning water supply operation is greater than or equal to the predefined cleaning-related reference water-level, the cleaning operation is initiated when the water-level of the water collector measured after completion of the cleaning water supply operation reaches the predefined cleaning-related reference water-level, wherein when the water-level of the water collector measured after completion of the cleaning water supply operation is lower than the predefined cleaning-related reference water-level, the cleaning operation is initiated when a predefined reference time duration has elapsed from a completion timing of the cleaning water supply operation.

9. The method of claim 8, further comprising at least one of:

a notification operation in which when the water-level of the water collector measured after completion of the cleaning water supply operation is lower than the predefined cleaning-related reference water-level, a message requesting a user not to empty water stored in the water discharger is outputted using at least one of a display panel or a speaker; or a locking operation in which when the water-level of the water collector measured after completion of the cleaning water supply operation is lower than the predefined cleaning-related reference water-level, a lock is activated to lock the water discharger.

10. The method of claim 2, further comprising:

a notification operation in which when the water-level of the water collector measured after completion of the cleaning water supply operation is lower than the predefined cleaning-related reference water-level, a message requesting a user to supply water to the water discharger is outputted using at least one of a display panel or a speaker; and a connection operation in which during the notification operation or after completion of the notification operation, the water supply valve opens the water supply pipe to connect the water discharger and the water collector to each other, wherein when the water-level of the water collector measured after completion of the connection operation is greater than or equal to the predefined cleaning-related reference water-level, the cleaning operation is initiated when the water-level of the water collector reaches the predefined cleaning-related reference water-level, wherein when the water-level of the water collector measured after completion of the connection operation is lower than the predefined cleaning-related reference water-level, the cleaning operation is initiated when a predefined reference time duration has elapsed after completion of the notification operation.

11. The method of claim 10, further comprising at least one of:

a notification operation in which when the water-level of the water collector measured after completion of the connection operation is lower than the predefined cleaning-related reference water-level, a message requesting a user not to empty water stored in the water discharger is outputted using at least one of a display panel or a speaker; or a locking operation in which when the water-level of the water collector measured after completion of the connection operation is lower than the predefined cleaning-related reference water-level, a lock is activated to lock the water discharger.

12. The method of claim 2, further comprising:

a prediction operation which occurs before initiation of the drying operation and in which an amount of water collectible in the water collector until the predefined reference dryness is satisfied is predicted based on an amount of laundry measured using a laundry amount sensor; and a prediction result notification operation in which when a sum of a water-level measured by a water discharger water-level sensor detecting a water-level inside the water discharger and a water-level corresponding to the amount of water predicted in the prediction operation is lower than the predefined cleaning-related reference water-level, a message requesting a user to supply water to the water discharger is outputted using at least one of a display panel or a speaker.

13. A laundry treating apparatus comprising:

a cabinet having a laundry inlet defined in a front face thereof;

a drum rotatably disposed inside the cabinet and having a laundry storage space defined therein, and communicating with the laundry inlet;

a duct defining a channel for supplying air discharged from the drum back to the drum;

a fan to allow air inside the drum to circulate along the duct;

a heat exchanger including a heat-absorber to remove moisture from air introduced into the duct and a heat-emitter disposed inside the duct to heat air passing through the heat-absorber;

a water collector for storing therein water removed from air passing through the heat-absorber;

a filter assembly disposed in the duct to filter air moving to the heat-absorber;

a water discharger including a water storage body detachably disposed in the cabinet and having a water storage space defined therein, and an inlet constructed to pass through the water storage body;

a water discharger supply pipe for guiding water stored in the water collector to the inlet;

a water ejector configured to eject water into at least one of the filter assembly or the heat-absorber;

a water ejector supply pipe for supplying water stored in the water collector to the water ejector;

a water supplier including:

a water discharge hole defined to pass through the water storage body to discharge water inside the water storage body therethrough;

a water discharge valve to open and close the water discharge hole;

a valve actuator to control the water discharge valve to open the water discharge hole when the water storage body is fixed to the cabinet;

a water supply pipe for guiding water discharged from the water discharge hole to the water collector; and a water supply valve for controlling opening and closing of the water supply pipe;

a water collector water-level sensor configured to detect a water-level inside the water collector; and a controller configured to control the water supply valve to move water from the water storage body to the water collector when the water-level measured using the water collector water-level sensor is lower than a predefined cleaning-related reference water-level.

14. The apparatus of claim 13, wherein the apparatus further comprises:

a communication hole defined to pass through a top face of the water storage body;

a storage body water supply hole defined to pass through a top face of the cabinet and located above the communication hole; and a water supply hole door configured to open and close the water supply hole.

15. The apparatus of claim 13, wherein the apparatus further comprises:

a water discharger insertion hole defined to pass through one face of the cabinet, wherein the water storage body is drawn out of the cabinet or inserted into the cabinet through the water discharger insertion hole;

a panel fixed to the water storage body and attachable or detachable to or from the water discharger insertion hole;

a panel water supply hole defined to pass through the panel;

a communication hole defined to pass through a top face of the water storage body; and a channel defining portion constructed to guide water flowing into the panel water supply hole to the communication hole.

16. The apparatus of claim 13, wherein the apparatus further comprises:

a water discharger insertion hole defined to pass through one face of the cabinet, wherein the water storage body is drawn out of the cabinet or inserted into the cabinet through the water discharger insertion hole;

a panel fixed to the water storage body and attachable or detachable to or from the water discharger insertion hole; and a lock, wherein the lock includes a bar fastener disposed on at least one of the panel or the water storage body, and a bar disposed on the cabinet and detachably coupled to the bar fastener.

17. The apparatus of claim 16, wherein when a water-level of the water collector measured after water in the water storage body is supplied to the water collector through the water supplier is lower than the predefined cleaning-related reference water-level, the controller is configured to control the lock so that the water storage body is fixed to the cabinet.

18. The apparatus of claim 13, wherein the apparatus further comprises:

a floater ascending or descending along a height direction of the water storage body according to a water-level inside the water storage body;

a permanent magnet fixed to the floater; and a magnetic force sensor disposed in the cabinet for transmitting a magnitude of a magnetic force exerted from the permanent magnet to the controller.

* * * * *